US007258969B2

(12) United States Patent
Sasaki et al.

(10) Patent No.: US 7,258,969 B2
(45) Date of Patent: Aug. 21, 2007

(54) SILVER HALIDE EMULSION, METHOD OF PREPARING THE SAME, AND SILVER HALIDE COLOR PHOTOGRAPHIC PHOTOSENSITIVE MATERIAL AND IMAGE-FORMING METHOD USING THE EMULSION

(75) Inventors: Hirotomo Sasaki, Kanagawa (JP); Hideki Maeta, Kanagawa (JP); Naoto Ohshima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/390,097

(22) Filed: Mar. 28, 2006

(65) Prior Publication Data

US 2006/0177780 A1 Aug. 10, 2006

Related U.S. Application Data

(62) Division of application No. 10/738,119, filed on Dec. 18, 2003, now Pat. No. 7,083,907, which is a division of application No. 09/966,984, filed on Oct. 1, 2001, now Pat. No. 6,750,004.

(30) Foreign Application Priority Data

Sep. 29, 2000 (JP) ..... 2000-298473
Sep. 29, 2000 (JP) ..... 2000-298477

(51) Int. Cl.
*G03C 1/10* (2006.01)

(52) U.S. Cl. ..... 430/603; 430/600; 430/605; 430/611

(58) Field of Classification Search ..... 430/567, 430/600, 603, 605, 611
See application file for complete search history.

(56) References Cited

U.S. PATENT DOCUMENTS 4,675,276 A 6/1987 Nakamura et al.
4,873,181 A 10/1989 Miyasaka et al.
5,004,679 A 4/1991 Mifune et al.
5,049,485 A 9/1991 Deaton
5,449,600 A 9/1995 Inagaki et al.
5,691,119 A 11/1997 Mydlarz et al.
5,719,019 A 2/1998 Janusonis et al.
5,726,005 A 3/1998 Chen et al.
5,736,310 A 4/1998 Chen et al.
5,783,373 A 7/1998 Mydlarz et al.
5,783,378 A 7/1998 Mydlarz et al.
5,830,631 A 11/1998 Hendricks et al.
5,945,270 A 8/1999 Lok et al.
6,140,035 A * 10/2000 Klingman et al. ..... 430/574
6,368,781 B1 4/2002 Ferguson et al.

FOREIGN PATENT DOCUMENTS

JP 57-000643 * 1/1982
JP 4-267249 A 9/1992
JP 7-34103 B2 4/1995
JP 10-123658 A 5/1998
JP 11-218870 A 8/1999

OTHER PUBLICATIONS

Abstract of JP 57-000643.*
Abstract of JP 01183646 A, Jul. 21, 1989.

* cited by examiner

*Primary Examiner*—Hoa Van Le
(74) *Attorney, Agent, or Firm*—Sughrue Mion, PLLC

(57) ABSTRACT

A silver halide emulsion which exhibits high sensitivity, high contrast, little sensitivity variation with humidity conditions at the time of exposure, and excellent reciprocity law properties at high illumination intensities. Also, a method of preparing the emulsion in a stable manner, and a silver halide color photographic photosensitive material and an image forming method that use the emulsion. The emulsion includes a mesoionic compound having a thiolate structure or a protonated thiolate structure, and the emulsion is sensitized by an Au (III) compound. The emulsion preferably contains an oxidatively dimerized form of a mesoionic compound having a thiolate structure, and a silver chloride content of at least 90 mol %.

7 Claims, No Drawings

SILVER HALIDE EMULSION, METHOD OF PREPARING THE SAME, AND SILVER HALIDE COLOR PHOTOGRAPHIC PHOTOSENSITIVE MATERIAL AND IMAGE-FORMING METHOD USING THE EMULSION

CROSS REFERENCE TO RELATED APPLICATIONS

This is a divisional of application Ser. No. 10/738,119 filed Dec. 18, 2003 now U.S. Pat. No. 7,083,907, which is a divisional of application Ser. No. 09/966,984 filed Oct. 1, 2001 now U.S. Pat. No. 6,750,004; the above noted prior applications are all hereby incorporated by reference.

BACKGROUND OF THE INVENTION

1. Field of the Invention

The present invention relates to a silver halide emulsion, a method of preparing the emulsion, and a silver halide color photographic photosensitive material and an image forming method using the emulsion. More specifically, the present invention relates to a silver halide emulsion, which exhibits high sensitivity, high contrast, little sensitivity variation with humidity conditions at the time of exposure, and excellent reciprocity law properties at high illumination intensities, to a method of preparing the emulsion in a stable manner, and to a silver halide color photographic photosensitive material and an image-forming method using the emulsion. Further, the present invention relates to a silver halide emulsion which provides high-contrast gradation at high sensitivity even by digital exposure such as exposure by laser scanning, and to a silver halide color photographic photosensitive material using the emulsion.

2. Description of the Related Art

In recent years, in the field of color photographic papers there has been an increasing demand for further improvements of such characteristics as sensitivity, image quality, and toughness at the time of processing. Accordingly, there is demand for an emulsion that provides high contrast and high sensitivity and exhibits little variation in photographic properties even under different temperature and humidity conditions at the time of exposure. Meanwhile, because of recent widespread use of laser scanning exposure apparatuses, suitability to short-time exposure at high illumination intensities has become an important characteristic. A remarkable feature of laser scanning exposure is that it enables speedup of exposure and improvement of resolution. However, when laser scanning exposure is applied to color photographic papers, suitability to exposure in very short times which have hitherto not been experienced (specifically, $10^{-6}$ seconds) is required at high illumination intensities.

Gold-sensitization is effective as a means for raising the sensitivity of a silver halide emulsion. As a gold compound for use in the gold-sensitization (occasionally, hereinafter referred to as "gold sensitizer"), a gold (I) compound containing a mesoionic ligand (this compound is hereinafter referred to as a "mesoionic gold (I) compound") is known. Japanese Patent Application Laid-Open (JP-A) No. 4-267249 discloses that a mesoionic gold (I) compound is useful for the manufacture of a high-sensitivity and high-contrast emulsion. However, as described in JP-A No. 11-218870, the mesoionic gold (I) compound is known to have low stability in a solution. Since stability of the gold sensitizer in a solution is an essential property for the production of an emulsion of reliable qualities in a stable manner, there is a demand for improvement of the stability.

As a measure to solve this problem, JP-A No. 11-218870 proposes a method in which a gold (I) complex of a mercapto compound is utilized as a gold sensitizer. However, although the solution stability of this gold sensitizer is improved, this gold sensitizer is still a compound that decomposes in a solution and therefore it does not satisfactorily solve the problem.

Besides the utilization of the gold (I) compound described above, it is also known to utilize an Au (III) compound such as chloroauric acid or the like. Since chloroauric acid is sufficiently stable in an aqueous solution, the use of chloroauric acid makes it possible to alleviate the productivity-related problem due to instability of the gold (I) complex. However, since the photographic properties such as sensitivity, gradation, suitability to high illumination intensity exposure, and toughness with respect to environmental temperature and humidity at the time of exposure are unsatisfactory, there is a demand for improvement. Accordingly, a means for producing, at a constant quality in a stable manner, a silver halide emulsion which satisfies the above-mentioned photographic properties has not been proposed and therefore there is a demand for solution of this problem.

In view of raising the toughness under various processing conditions, in particular toughness with respect to wet abrasion, JP-A No. 10-123658 discloses that an emulsion containing a specific disulfide compound is effective. However, since the photographic properties such as sensitivity, gradation, suitability to high illumination intensity exposure, and toughness with respect to environmental temperature and humidity at the time of exposure are particularly unsatisfactory in connection with the gold sensitizer comprising an Au (III) compound, there is demand for improvement.

Meanwhile, because of the requirement for rapid processability, mainly for higher productivity, silver halide emulsion having a high silver chloride content is used in color photographic papers. Generally, such silver halide emulsion having a high silver chloride content tends to exhibit low sensitivity and soft tones after high illumination intensity exposure. Accordingly, a variety of techniques to alleviate this problem have been disclosed.

In order to alleviate high illumination intensity reciprocity failure of a silver halide emulsion, it has been known to dope iridium. However, silver chloride emulsion doped with iridium is known to cause latent image sensitization shortly after exposure. For example, according to Japanese Patent Application Publication (JP-B) No. 7-34103, the problem of latent image sensitization is solved by providing a localized phase having a high silver bromide content and doping this phase with iridium. The silver halide emulsion prepared by this method exhibits high sensitivity and high contrast even with a relatively high illumination intensity exposure of about 1/100 seconds. However, this silver halide emulsion has been found to pose a problem that it is difficult to obtain high-contrast gradation while maintaining high sensitivity up to ultrahigh illumination intensity exposures of 1 μsecond, which are required in a digital exposure system with laser scanning exposure. U.S. Pat. No. 5,691,119 discloses a method for preparation of an emulsion made up of grains having localized phases rich in silver bromide to obtain high-contrast gradation in high illumination intensity exposure. However, the effect of this method is not sufficient and a problem of this method is that performance is not stable when the preparation is repeated.

U.S. Pat. Nos. 5,783,373 and 5,783,378 disclose a method to alleviate the high intensity reciprocity failure and produce high contrast, by use of at least 3 kinds of dopants. But this high-contrast gradation is obtained by use of dopants that produce high contrast by desensitization and therefore this method is incompatible with the creation of high sensitivity in principle.

U.S. Pat. Nos. 5,726,005 and 5,736,310 disclose an emulsion having high sensitivity and little high intensity reciprocity failure, obtained by including a silver chloride-rich emulsion containing iodine having a peak concentration on the grain subsurface. This emulsion exhibits higher sensitivity as the intensity of illumination for exposure becomes higher, but it was found that the gradation was very soft and the emulsion was not suitable to digital exposure in which the dynamic range of light amount is limited.

U.S. Pat. No. 5,049,485 discloses that chemical sensitization by an Au (I) compound having a mesoionic coordination leads to high sensitivity and high contrast. U.S. Pat. No. 5,945,270 discloses that chemical sensitization by an Au (I) compound having a water-soluble group-bearing mercapto coordination leads to high sensitivity and high contrast. These Au (I) compounds are known to be relatively stable, but no mention is made as to whether use of these Au (I) compounds is suitable for high illumination intensity exposure.

SUMMARY OF THE INVENTION

It is accordingly an object of the present invention to provide a silver halide emulsion which exhibits high sensitivity, high contrast, little sensitivity variation with humidity conditions at the time of exposure, and excellent reciprocity law properties at high illumination intensities. Another object of the present invention is to provide a method of preparing the emulsion having high sensitivity in a stable manner. A further object of the present invention is to provide a silver halide color photographic photosensitive material and an image forming method which exhibit high sensitivity, high contrast, little sensitivity variation depending on humidity conditions at the time of exposure, and excellent reciprocity law properties at high illumination intensities. A still further object of the present invention is to provide a silver halide emulsion, which provides a high-contrast gradation at a high sensitivity, even by a digital exposure such as exposure by laser scanning, without causing low sensitivity or soft tones, and a silver halide color photographic photosensitive material using the emulsion.

The above-mentioned objects can be achieved by the following means.

A first aspect of the present invention is a silver halide emulsion which contains at least one of a mesoionic compound having a thiolate structure and a mesoionic compound having a protonated thiolate structure, wherein the emulsion is sensitized by an Au (III) compound.

A second aspect of the present invention is a silver halide emulsion which contains an oxidatively dimerized form of a mesoionic compound having a thiolate structure, and silver chloride of at least 90 mol % by content.

A third aspect of the present invention is a method of preparing a silver halide emulsion, the method including the steps of: (a) preparing a silver halide emulsion including silver chloride of at least 90 mol % by content; (b) adding at least one of a mesoionic compound having a thiolate structure and a mesoionic compound having a protonated thiolate structure to the emulsion; and (c) adding an Au (III) compound to the silver halide emulsion.

A fourth aspect of the present invention is a method of preparing a silver halide emulsion, the method including the steps of: (a) preparing a silver halide emulsion including silver chloride of at least 90 mol % by content; (b) adding an oxidatively dimerized form of a mesoionic compound having a thiolate structure to the emulsion; and (c) carrying out gold sensitization.

A fifth aspect of the present invention is a silver halide emulsion which contains an iridium-doped silver chloroiodide or silver chlorobromoiodide including silver chloride of at least 90 mol % by content and silver iodide in the range of 0.02 to 1 mol % by content, and chemically sensitized by a gold sensitizer whose stability constant of gold complex log $\beta_2$ is in the range of 21 to 35.

A sixth aspect of the present invention is a silver halide color photographic photosensitive material having a support, and, disposed on the support, at least one blue-sensitive silver halide emulsion layer, at least one green-sensitive silver halide emulsion layer, and at least one red-sensitive silver halide emulsion layer, wherein at least one of the blue-sensitive silver halide emulsion layer, the green-sensitive silver halide emulsion layer, and the red-sensitive silver halide emulsion layer includes the silver halide emulsion of the first aspect.

A seventh aspect of the present invention is a silver halide color photographic photosensitive material having a support, and, disposed on the support, at least one blue-sensitive silver halide emulsion layer, at least one green-sensitive silver halide emulsion layer, and at least one red-sensitive silver halide emulsion layer, wherein at least one of the blue-sensitive silver halide emulsion layer, the green-sensitive silver halide emulsion layer, and the red-sensitive silver halide emulsion layer includes the silver halide emulsion of the second aspect.

An eighth aspect of the present invention is a silver halide color photographic photosensitive material having a support, and, disposed on the support, at least one silver halide emulsion layer including a yellow dye-forming coupler, at least one silver halide emulsion layer including a magenta dye-forming coupler, and at least one silver halide emulsion layer including a cyan dye-forming coupler, wherein at least one of the silver halide emulsion layers comprises a silver halide emulsion according to the fifth aspect.

A ninth aspect of the present invention is an image-forming method including the steps of: exposing a silver halide color photographic photosensitive material according to the sixth aspect on the basis of image information; and thereafter developing the silver halide color photographic photosensitive material, wherein the exposing step includes the step of scanning the silver halide color photographic photosensitive material with a laser beam modulated on the basis of the image information, with an exposure time per pixel of at most $10^{-4}$ seconds.

A tenth aspect of the present invention is an image-forming method including the steps of: exposing a silver halide color photographic photosensitive material according to the seventh aspect on the basis of image information; and thereafter developing the silver halide color photographic photosensitive material, wherein the exposing step includes the step of scanning the silver halide color photographic photosensitive material with a laser beam modulated on the basis of the image information, with an exposure time per pixel of at most $10^{-4}$ seconds.

An eleventh aspect of the present invention is an image-forming method including the steps of: exposing a silver halide color photographic photosensitive material according to the eighth aspect on the basis of image information; and thereafter, developing the silver halide color photographic photosensitive material, wherein the exposing step includes the step of scanning the silver halide color photographic photosensitive material with a laser beam modulated on the basis of the image information, with an exposure time per pixel of at most $10^{-4}$ seconds.

DETAILED DESCRIPTION OF THE PREFERRED EMBODIMENTS

The details of first to fourth embodiments (silver halide emulsions and methods of preparing the emulsions) of the present invention are given below.

A mesoionic compound having a thiolate structure or having a protonated thiolate structure for use in the present invention is described.

The mesoionic compound for use in the present invention can be represented by the following general formula (I).

General formula (I)

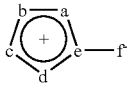

In the general formula (I), f represents a sulfur atom, e represents a carbon atom, and a, b, c, and d are each an unsubstituted or substituted atom constituting a 5-membered ring of the mesoionic compound and each independently represents a C—R group, an N—R' group, an oxygen atom, or a sulfur atom, where R and R' each independently represents a hydrogen atom or a substituent.

The mesoionic compound having a protonated thiolate structure for use in the present invention is a compound in which f, i.e., a thiolate group in the general formula (I), is protonated. The protonated thiolate group is represented by an SH group. Since pKa for the SH group is low, almost all protons of SH are dissociated in a neutral aqueous solution so that a mesoionic compound having a thiolate structure is formed. In the present invention, a mesoionic compound having a thiolate structure and/or a mesoionic compound having a protonated thiolate structure can be used. Preferably, a mesoionic compound having a thiolate structure is used.

Examples of the substituent represented by R or R' include the following.

An alkyl group (a straight or branched alkyl group having preferably 1 to 20, more preferably 1 to 10, carbon atoms, e.g., methyl, ethyl, i-propyl, t-butyl, or n-octyl), a cycloalkyl group (a cycloalkyl group having preferably 3 to 20, more preferably 3 to 10, carbon atoms, e.g., cyclopropyl, cyclopentyl, or cyclohexyl), an aryl group (a monocyclic or condensed-ring aryl group having preferably 6 to 20, more preferably 6 to 10, carbon atoms, e.g., phenyl, naphthyl, or 4-methylphenyl), an alkenyl group (an alkenyl group having preferably 2 to 20, more preferably 2 to 10, carbon atoms, e.g., allyl, 2-butenyl, or 3-pentenyl), an alkynyl group (an alkynyl group having preferably 2 to 20, more preferably 2 to 10, carbon atoms, e.g., propargyl or 3-pentynyl), an aralkyl group (an aralkyl group having preferably 7 to 20, more preferably 7 to 10, carbon atoms, e.g., benzyl or phenethyl), a heterocyclic group (a heterocyclic group having preferably 0 to 20, more preferably 0 to 10, carbon atoms, and having at least one heteroatom as a ring-constituting atom selected from an oxygen atom, a sulfur atom, a nitrogen atom, and a carbon atom, e.g., pyridyl, furyl, imidazolyl, piperidyl, or morpholino), a halogen atom (e.g., fluorine atom, chlorine atom, or bromine atom), an alkoxy group (an alkoxy group having preferably 1 to 20, more preferably 1 to 10, carbon atoms, e.g., methoxy, ethoxy, or butoxy), an aryloxy group (an aryloxy group having preferably 6 to 20, more preferably 6 to 10, carbon atoms, e.g., phenoxy or 2-naphthyloxy), an amino group (an amino group having preferably 0 to 20, more preferably 0 to 10, carbon atoms, e.g., unsubstituted amino, dimethylamino, ethylamino, or anilino), a ureido group (a ureido group having preferably 1 to 20, more preferably 1 to 10, carbon atoms, e.g., unsubstituted ureido, N-methylureido, or N-phenylureido), a urethane group (a urethane group having preferably 1 to 20, more preferably 1 to 10, carbon atoms, e.g., methoxycarbonylamino or phenoxycarbonylamino), a sulfonyl group (a sulfonyl group having preferably 1 to 20, more preferably 1 to 10, carbon atoms, e.g., mesyl or tosyl), a sulfinyl group (a sulfinyl group having preferably 1 to 20, more preferably 1 to 10, carbon atoms, e.g., methylsulfinyl or phenylsulfinyl), a sulfonamide group (a sulfonamide group having preferably 1 to 20, more preferably 1 to 10, carbon atoms, e.g., methanesulfonamide), a sulfamoyl group (a sulfamoyl group having preferably 1 to 20, more preferably 1 to 10, carbon atoms, e.g., N-methylsulfamoyl), an alkyloxycarbonyl group (an alkyloxycarbonyl group having preferably 2 to 20, more preferably 2 to 10, carbon atoms, e.g., methoxycarbonyl or ethoxycarbonyl), an aryloxycarbonyl group (an aryloxycarbonyl group having preferably 6 to 20, more preferably 6 to 10, carbon atoms, e.g., phenoxycarbonyl), an acyl group (an acyl group having preferably 1 to 20, more preferably 1 to 10, carbon atoms, e.g., acetyl, benzoyl, formyl, or pivaloyl), an acyloxy group (an acyloxy group having preferably 1 to 20, more preferably 1 to 10, carbon atoms, e.g., acetoxy or benzoyloxy), an alkylthio group (an alkylthio group having preferably 1 to 20, more preferably 1 to 10, carbon atoms, e.g., methylthio or ethylthio), an arylthio group (an arylthio group having preferably 6 to 20, more preferably 6 to 10, carbon atoms, e.g., phenylthio), a cyano group, a hydroxyl group, a mercapto group, a carboxyl group, a phosphono group, a nitro group, a sulfo group, a sulfino group, an ammonio group (e.g., trimethylammonio), and a silyl group (e.g., trimethylsilyl).

Among the groups represented by R or R', a hydrogen atom, an alkyl group, and an aryl group are preferable, a hydrogen atom and an alkyl group are more preferable, and an alkyl group is most preferable.

The groups represented by R or R' listed above may further have a substituent. Examples of the substituent include the groups represented by R or R' as listed above.

In the case where two or more substituents represented by R or R' are present, these substituents may be the same or different.

Further, a, b, c, and d may join together to form a ring via an adjoining bond.

The mesoionic compound of the general formula (I), where f is an SH group (i.e., in the case of a mesoionic compound having a protonated thiolate structure), has an anion which neutralizes the charge of the molecule. Examples of the anion include an inorganic anion such as a halogen ion, e.g., a chlorine ion or a bromine ion, and a conjugate base of an organic acid such as an acetate ion or trifluoroacetate ion.

Examples of the mesoionic compound represented by the general formula (I) include 1,3-diazolium-4-thiolates, 1,3-thiazolium-5-thiolates, 1,2,3-oxadiazolium-5-thiolates, 1,3,4-oxadiazolium-2-thiolates, 1,2,3-triazolium-4-thiolates, 1,2,4-triazolium-3-thiolates, 1,2,3-thiadiazolium-5-thiolates, 1,3,4-thiadiazolium-2-thiolates, 1,2,3,4-oxatriazolium-5-thiolates, 1,2,3,4-tetrazolium-5-thiolates, 1,2,3,4-thiatriazolium-5-thiolates, and 1,2-dithiolium-4-thiolates.

Compounds represented by the general formula (I) that are preferably used in the present invention are 1,3-diazolium-4-thiolates, 1,3-thiazolium-5-thiolates, 1,2,3-oxadiazolium-5-thiolates, 1,3,4-oxadiazolium-2-thiolates, 1,2,3-triazolium-4-thiolates, 1,2,4-triazolium-3-thiolates, 1,2,3-thiadiazolium-5-thiolates, and 1,3,4-thiadiazolium-2-thiolates.

Compounds represented by the general formula (I) that are more preferably used in the present invention are 1,3-diazolium-4-thiolates, 1,3-thiazolium-5-thiolates, 1,2,3-triazolium-4-thiolates, and 1,2,4-triazolium-3-thiolates.

Compounds represented by the general formula (I) that are further preferably used in the present invention are 1,3-diazolium-4-thiolates, 1,3-thiazolium-5-thiolates, and 1,2,4-triazolium-3-thiolates.

Compounds represented by the general formula (I) that are most preferably used in the present invention are 1,2,4-triazolium-3-thiolates.

The compound represented by the general formula (I) has a total number of carbon atoms of preferably 2 to 30, more preferably 2 to 20, and most preferably 2 to 12.

Specific examples of the mesoionic compound having a thiolate structure for use in the present invention (exemplary compounds I-1 to 22) are exemplified below. However, it should be noted that compounds for use in the present invention are not limited to these exemplary compounds. In the following exemplary compounds, a compound in which —S⁻ is formed into —SH and an arbitrary counter anion is added can be a specific example of the mesoionic compound having a protonated thiolate structure.

I-1

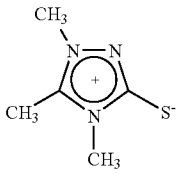

I-2

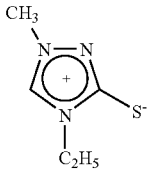

I-3

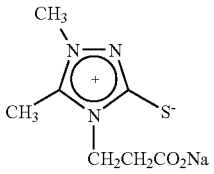

I-4

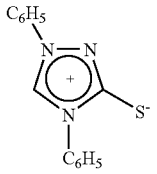

-continued

I-5

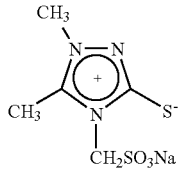

I-6

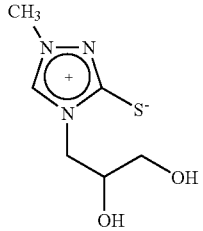

I-7

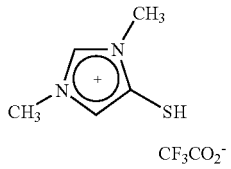

I-8

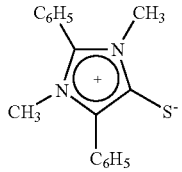

I-9

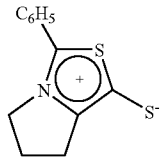

I-10

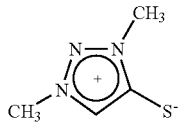

I-11

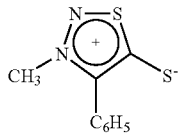

I-12

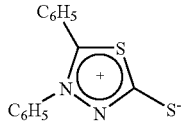

I-13

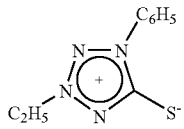

-continued

I-14

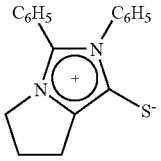

I-15

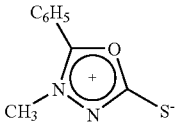

I-16

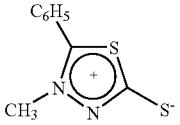

I-17

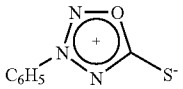

I-18

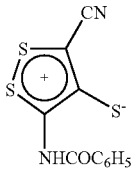

I-19

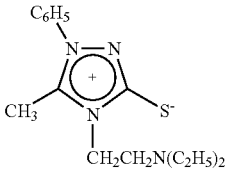

I-20

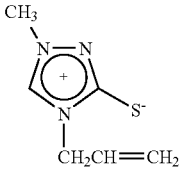

I-21

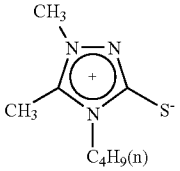

I-22

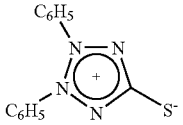

In the present invention, the compounds represented by the general formula (I) can be synthesized according to the synthesis procedures described in the following literature. For example, Ramsden et al., Tetrahedron, Vol. 38, pages 2965-3011, 1982; ibid., Vol. 33, pages 3203-3232, 1977; and Advances in Heterocyclic Chemistry, Vol. 19, pages 1-122, 1976.

In the present invention, although the amount of the mesoionic compound (including mesoionic compounds having a thiolate structure and mesoionic compounds having a protonated thiolate structure; this applies hereinafter) to be added may vary in a wide range depending on the case, the amount is normally $1\times10^{-6}$ to $5\times10^{-3}$ moles and preferably $5\times10^{-6}$ to $5\times10^{-4}$ moles per mole of silver halide.

The silver halide emulsion of the present invention is sensitized, preferably by using an Au (III) compound. Conventionally known gold sensitizers may be used as the Au (III) compound. Specific examples of the compound that can be used include chloroauric acid, potassium tetrachloroaurate, ammonium tetrachloroaurate, potassium tetrabromoaurate, auric chloride, auric bromide, auric iodide, potassium auric iodide, and gold (III) hydroxide.

In the present invention, the mesoionic compound and the Au (III) compound may be added simultaneously or separately to the silver halide emulsion. The addition may be made between the point of time when silver halide grain formation finishes and the point of time when chemical sensitization finishes. The addition is made preferably at the time of chemical sensitization or at a time of after-ripening. The ratio (molar ratio) of the mesoionic compound to the Au (III) compound to be added may be 20/1 to 0.5/1. The ratio is preferably 15/1 to 1/1, more preferably 10/1 to 2/1, and most preferably 8/1 to 4/1.

It is also possible to mix the Au (III) compound and the mesoionic compound together in a solvent and add the mixture to the silver halide emulsion. Examples of the solvent that can be used for this mixing include water and alcohol. Water is preferable. The pH of the solvent can be controlled by addition of an acid or alkali, and a solvent whose pH is 13 or less can be used. The pH is preferably 2 to 11 and more preferably 3 to 8. The time period between the time when the Au (III) compound and the mesoionic compound are mixed together and the time when the mixture is added to the silver halide emulsion is preferably not more than 3 days, more preferably not more than 1 day, and most preferably not more than 6 hours, in view of the stability of the mixture solution.

The most preferred method of adding the Au (III) compound and the mesoionic compound to the silver halide emulsion is mixing these compounds together in a solvent in advance and adding the mixture to the silver halide emulsion.

In the present invention, although the amount of the Au (III) compound to be added may vary in a wide range depending on the case, the amount is normally $5\times10^{-7}$ to $5\times10^{-3}$ moles and preferably $5\times10^{-6}$ to $5\times10^{-4}$ moles per mole of silver halide.

The silver halide emulsion of the present invention may be sensitized by a gold sensitization method using the Au (III) compound combined with another sensitizing method such as sulfur sensitization, selenium sensitization, tellurium sensitization, reduction sensitization, or noble metal sensitization using a compound other than a gold compound. In the present invention, a combination of gold sensitization and sulfur sensitization is preferable.

The silver halide emulsion of the present invention differs from the conventional silver halide emulsion described in JP-A No. 4-267249 which is obtained by a gold sensitization method using a mesoionic gold(I) compound in that the effect of the present invention is exhibited by use of the mesoionic compound and the Au (III) compound. Also, the silver halide emulsion of the present invention has the following advantages.

The first advantage of the silver halide emulsion of the present invention is that an emulsion having consistent quality can be prepared over a long period of time in a stable manner. More specifically, whereas the mesoionic compounds for use in the present invention (e.g., exemplary compounds I-1, I-2, I-3, I-4, and I-5) cause no change in UV absorption spectra after storage at 30° C. for 4 weeks, bis(1,4,5-trimethyl-1,2,4-triazolium-3-thiolato)gold(I) tetrafluoroborate does cause a change in the UV absorption spectra. Accordingly, the silver halide emulsion of the present invention, which uses the stable mesoionic compound together with the Au (III) compound, has the advantage that an emulsion having consistent quality can be prepared over a long period of time in a stable manner since a mesoionic gold compound exhibiting instability in a solution is not used. This effect will be shown in the examples. The second advantage of the silver halide emulsion of the present invention is that the emulsion exhibits high sensitivity both at a low illumination intensity and at a high illumination intensity in comparison with conventional silver halide emulsions and has good photographic properties such as excellent toughness with respect to variation of humidity at the time of exposure. This effect will also be shown in the Examples.

According to one embodiment of the present invention, an oxidatively dimerized form of a mesoionic compound having a thiolate structure is used. The oxidatively dimerized form is obtained by mixing a mesoionic compound having a thiolate structure and an Au (III) compound together so that the mesoionic compound is oxidized. In particular, by mixing the mesoionic compound and the Au (III) compound prior to addition to a silver halide emulsion, the oxidatively dimerized form of the mesoionic compound, in roughly the same molar number as that of the Au (III) compound, can be generated. The silver halide emulsion in this embodiment of the present invention differs from the silver halide emulsion described in JP-A No. 4-267249 which is obtained by a gold sensitization method using a mesoionic gold (I) compound in that the silver halide emulsion of the present invention has the advantage described above and contains the oxidatively dimerized form described above.

Next, the oxidatively dimerized form of a mesoionic compound having a thiolate structure for use in the present invention (hereinafter referred to simply as "mesoionic oxidized form" or "oxidized form") is explained.

The mesoionic oxidized form is an oxidatively dimerized form of a mesoionic compound represented by the general formula (I) and is a compound in which the f group in the general formula (I) is oxidized. Accordingly, the mesoionic oxidized form can be represented by the following general formula (II).

General formula (II)

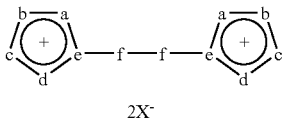

In the general formula (II), f represents a sulfur atom, e represents a carbon atom, and a, b, c, and d are each an unsubstituted or substituted atom constituting an aromatic 5-membered heterocycle having a positive charge and each independently represents a C—R group, an N—R' group, an oxygen atom, or a sulfur atom, where R and R' each independently represents a hydrogen atom or a substituent. These a, b, c, d, e, f, C—R group, N—R' group, R, and R' have the same meanings as a, b, c, d, e, f, C—R group, N—R' group, R, and R' in the general formula (I), respectively. The oxidized form that is preferably used in the present invention is an oxidized form of a compound listed as a preferable example among the compounds represented by the general formula (I).

In the general formula (II), X represents an anion which neutralizes the charge of the molecule of the oxidized form. Examples of the anion include an inorganic ion such as a halogen ion, e.g., a chlorine ion or a bromine ion, or a tetrafluoroborate anion, or an organic anion such as an acetate ion. A chlorine ion and a tetrafluoroborate anion are preferable.

Specific examples of the compound represented by the general formula (II) (exemplary compounds II-1 to 3) are given below. However, it should be noted that the compounds for use in the present invention are not limited to these exemplary compounds. Therefore, any oxidatively dimerized form of the compound represented by the general formula (I) can be used in the present invention.

II-1

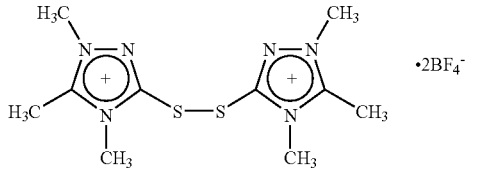

II-2

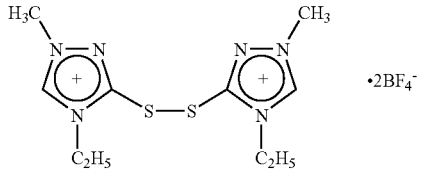

II-3

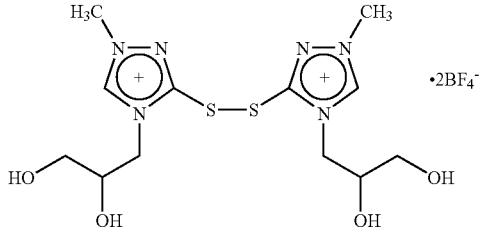

The mesoionic oxidized form can be easily obtained by mixing the mesoionic compound represented by the general formula (I) with an Au (III) compound, such as chloroauric acid, potassium tetrachloroaurate, ammonium tetrachloroaurate, potassium tetrabromoaurate, auric chloride, or auric bromide, in water. In the present invention, the oxidized form produced by mixing a mesoionic compound with an Au (III) compound can be utilized without being isolated. However, an oxidized form that has been subjected to isolation may be added to a silver halide emulsion.

Specific examples of synthesis and isolation of a mesoionic oxidized form that can be used in the present invention are given below.

At room temperature, 30 mL of an aqueous solution containing the exemplary compound I-1 (13.9 g, 97 mmol) was added dropwise to 200 mL of an aqueous solution of chloroauric acid ($HAuCl_4.4H_2O$) (10.0 g, 24.2 mmol). The mixture was stirred for 15 minutes. This mixture was designated as reaction liquid A. 10.9 mL of a 42% $HBF_4$ aqueous solution was added dropwise to the reaction liquid A. During the dropwise addition, a white precipitate was produced. After the dropwise addition, the reaction mixture was stirred for 15 minutes and thereafter cooled to 5° C. 30 minutes later, the white precipitate was isolated by filtration. The white crystals thus obtained were confirmed to be bis(1,4,5-trimethyl-1,2,4-triazolium-3-thiolato)gold(I) tetrafluoroborate by means of NMR, IR, and elemental analysis. The filtrate was concentrated and 100 mL of ethanol was added to the concentrated filtrate. The addition of ethanol caused the deposition of a white precipitate. The white precipitate was collected by filtration, washed with ethanol, and thereafter dried. In this manner, the desired product was obtained in a high yield. The white crystals thus obtained were confirmed to be the exemplary compound II-1 by means of NMR, IR, mass spectrometry and elemental analysis.

A mixture solution like the reaction liquid A can be used instead of the addition of the exemplary compound II-1 in the present invention.

The mesoionic oxidized form for use in the present invention is a compound having a disulfide structure. Specific compounds having a disulfide structure are disclosed in JP-A No. 10-123658 and others. But the structure of the mesoionic oxidized form for use in the present invention is entirely different from the structure of the above-mentioned disulfide compounds in that the mesoionic oxidized form for use in the present invention has an aromatic heterocycle having a positive charge. Besides, when the disulfide compound described in JP-A No. 10-123658 is used together with an Au (III) compound (a gold sensitizer), an undesirable effect that the sensitivity is somewhat lowered by the disulfide compound is found. By contrast, the advantage of the present invention is that the sensitivity is not lowered even when the mesoionic oxidized form is used together with an Au (III) compound.

Next, the silver halide grains contained in the silver halide emulsion of the present invention are explained.

Preferable as the silver halide grains are cubic or tetradecahedral crystal grains substantially having a {100} plane (the grain may have a round apex and a plane of a further higher order); octahedral crystal grains; and tabular grains having an aspect ratio of 2 or more characterized in that 50% or more of the total projected area thereof is made up of a {100} plane or {111} plane. The aspect ratio is a value obtained by dividing the equivalent-circle diameter of the projected area of a grain by the grain thickness. In the present invention, cubic grains, tabular grains having a {100} plane as a principal plane, or tabular grains having a {111} plane as a principal plane are particularly preferably used.

A silver chloride, silver bromide, silver iodobromide, or silver chloro(iodo)bromide emulsion or the like can be used as the silver halide emulsion of the present invention. Among these emulsions, silver chloride, silver chlorobromide, silver chloroiodide, or silver chlorobromoiodide emulsion, each having a silver chloride content of 90 mol % or more, preferably 95 mol % or more, and more preferably 98 mol % or more, is preferable from the standpoint of rapid processability. Among these silver halide emulsions, an emulsion which is composed of silver halide grains whose shell portions have a silver iodochloride phase that makes up 0.01 to 0.50 mol %, preferably 0.05 to 0.40 mol %, per total moles of silver, is also preferable because such an emulsion exhibits high sensitivity and excellent suitability to high illumination intensity exposure. Further, an emulsion which is composed of silver halide grains having on the surface thereof a localized silver bromide phase that makes up 0.2 to 5 mol %, preferably 0.5 to 3 mol %, per total moles of silver, is particularly preferable because such an emulsion exhibits high sensitivity and stabilized photographic performance.

For silver halide content in a silver halide emulsion, when the content is indicated by "mol %", the mol % means mol % per total moles of silver element contained in the silver halide emulsion.

In the case where the silver halide emulsion of the present invention contains silver iodide, the details of introduction of iodide ions, etc. are the same as in the explanation of the fifth embodiment of the present invention described later.

In the case where the silver halide emulsion of the present invention has a localized silver bromide phase, it is preferable to prepare the silver halide grains by epitaxially growing the localized silver bromide phase having a silver bromide content of at least 10 mol % on the grain surface. The silver bromide content in the localized silver bromide phase is preferably in the range of 10 to 60 mol % and most preferably in the range of 20 to 50 mol %. The localized silver bromide phase is made up of preferably 0.1 to 5 mol % of silver, more preferably 0.3 to 4 mol % of silver, based on the total moles of silver constituting the silver halide grain. It is preferable to incorporate a complex compound of a Group VIII metal such as iridium (III) chloride, iridium (III) bromide, iridium (IV) chloride, sodium hexachloroiridate (III), potassium hexachloroiridate (IV), a hexaammineiridium (IV) salt, a trioxalatoiridate (III), or a trioxalatoiridate (IV) into the localized silver bromide phase. Although the amounts of these compounds to be added vary widely depending on purposes, amounts in the range of $10^{-9}$ to $10^{-2}$ per mole of silver halide are preferable.

In the present invention, it is possible to incorporate metal ions into the interior and/or surface of silver halide grains by the addition of transition metal ions at a step in which the silver halide grains are formed and/or grown. The metal ions to be used are preferably transition metal ions. Among transition metals, iron, ruthenium, iridium, osmium, lead, cadmium, or zinc is preferable. Further, it is preferable that the metal ion is accompanied by a ligand and that the metal is used as a hexacoordinate octahedral complex. The ligand may be an inorganic compound or an organic compound. If an inorganic compound is used as the ligand, it is preferable to use cyanide ions, halide ions, thiocyanate ions, hydroxide ions, peroxide ions, azide ions, nitrite ions, water, ammonia, nitrosyl ions, or thionitrosyl ions. It is also preferable to coordinate any kind of these ligands with any of the above-mentioned ions of metals, i.e., iron, ruthenium, iridium, osmium, lead, cadmium, and zinc. Further, it is also preferable to use plural kinds of ligands in one complex molecule. On the other hand, if an organic compound is used as the ligand, a linear compound whose main chain has 5 or less carbon atoms and/or a 5-membered or 6-membered heterocyclic compound are preferably used. A compound having in the molecule thereof a nitrogen atom, a phosphorus atom, an oxygen atom, or a sulfur atom as an atom coordinating to a metal is more preferable as the organic compound. In this regard, furan, thiophene, oxazole, isoxazole, thiazole, isothiazole, imidazole, pyrazole, triazole, furazane, pyran, pyridine, pyridazine, pyrimidine, and pyrazine are most preferable. Further, a compound which comprises any of the above-mentioned compounds as a skeleton and a substituent introduced thereto is also preferable.

A preferred combination of the metal ion and the ligand is the combination of an iron or ruthenium ion and a cyanide ion. In this compound, the cyanide ions account for the majority of a coordination number of the iron or ruthenium that is the central metal, such that the remaining coordination sites are occupied by thiocyanate ions, ammonia, water, nitrosyl ions, dimethyl sulfoxide, pyridine, pyrazine, or 4,4'-bipyridine. The most preferred is the formation of a hexacyanoferrate or hexacyanoruthenate complex such that all of the 6 coordination sites of the central metal are occupied by cyanide ions. The amount of the complex that has cyanide ions as ligands and is to be added during the silver halide grain formation is preferably $1\times10^{-8}$ to $1\times10^{-2}$ moles and most preferably $1\times10^{-6}$ to $5\times10^{-4}$ moles per mole of silver.

When iridium is used as the central metal, preferred examples of the ligand include a fluoride ion, a chloride ion, a bromide ion, and an iodide ion. Among these ions, the use of a chloride ion or a bromide ion is preferable. Preferred specific examples of the iridium complex include $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$. The amount of the iridium complex to be added during the silver halide grain formation is preferably $1\times10^{-10}$ to $1\times10^{-3}$ moles and most preferably $1\times10^{-8}$ to $1\times10^{-5}$ moles per mole of silver. In the case where ruthenium or osmium is used as the central metal, it is also preferable to use a nitrosyl ion, a thionitrosyl ion, or a water molecule together with a chloride ion as a ligand. More preferable is the formation of a pentachloronitrosyl complex, a pentachlorothionitrosyl complex, or a pentachloroaqua complex. It is also preferable to form a hexachloro complex. The amount of the complex to be added during the silver halide grain formation is preferably $1\times10^{-10}$ to $1\times10^{-6}$ moles and more preferably $1\times10^{-9}$ to $1\times10^{-6}$ moles per mole of silver.

It is preferable to incorporate the metal complex into the silver halide grain by addition of the metal complex directly into a reaction solution at the time of silver halide grain formation or by addition of the metal complex into the grain-forming reaction solution through addition of the metal complex to a halide aqueous solution for silver halide grain formation or another solution. It is also preferable to incorporate the metal complex into the silver halide grain by a combination of these methods. Where the metal complex is incorporated into the silver halide grain, one example of preferred modes is the incorporation of the metal complex only into the grain surface layer, as disclosed in JP-A Nos. 4-208936, 2-125245, and 3-188437, and another example of preferred modes is the incorporation of the metal complex only into the grain interior so that the grain surface is covered with a layer which does not contain the metal complex, although uniform distribution of the metal complex inside the grain is also a preferred mode. It is also preferable to modify the grain surface phase by carrying out physical ripening using fine grains having the complex incorporated into the grain interior, as disclosed in U.S. Pat. Nos. 5,252,451 and 5,256,530. Further, a combination of these methods may be employed, and plural kinds of the complexes may be incorporated into one silver halide grain. The halogen composition of the site at which the complex is incorporated is not particularly limited, and it is also preferable to incorporate the complex into any of a silver chloride layer, a silver chlorobromide layer, a silver bromide layer, a silver iodochloride layer, and a silver iodobromide layer.

The average grain size (i.e., the number average of grain sizes defined by diameters of circles equivalent to projected areas of the grains) of the silver halide grains to be contained in the silver halide emulsion of the present invention is preferably 0.1 to 2 μm. The grain size distribution is preferably a so-called monodispersed one whose variation coefficient (i.e., a value obtained by dividing the standard deviation of the grain size distribution by the average grain size) is not more than 20%, preferably not more than 15%, and more preferably not more than 10%. In this case, in order to obtain a broad latitude, it is also preferable to form a single layer using a blend of two or more kinds of the monodispersed emulsions, each having a different average grain size, or to form multiple layers.

The following explanation about additives to the silver halide emulsion applies also to the fifth embodiment of the present invention described later.

For prevention of fogging during manufacture, storage, or photographic processing of the photosensitive material or for stabilization of photographic performance, various compounds or precursors thereof may be added to the silver halide emulsion for use in the present invention. Specific examples of these additives are preferably the compounds described in JP-A No. 62-215272, pages 39-72. Further, a 5-arylamino-1,2,3,4-thiatriazole compound (in which the aryl residue has at least one electron-withdrawing group) described in EP0447647 is also preferably used.

For enhancement of storability of the silver halide emulsion of the present invention, compounds that are preferably used also in the present invention are hydroxamic acid derivatives described in JP-A No. 11-109576; cyclic ketones having a double bond which adjoins to the carbonyl group, described in JP-A No. 11-327094, and whose both ends are substituted with an amino group or hydroxyl group (particularly those represented by the general formula (S1) and paragraphs 0036 to 0071 thereof can be incorporated herein); sulfo-substituted catechols or hydroquinones described in JP-A No. 11-143011 (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts thereof); hydroxylamines represented by the general formula (A) in U.S. Pat. No. 5,556,741 (the description from column 4, line 56, to column 11, line 22, in U.S. Pat. No. 5,556,741 is preferably applicable and partly incorporated herein); and water-soluble reducing agents represented by the general formulae (I) to (III) described in JP-A No. 11-102045.

A so-called spectral sensitizing dye may be incorporated in the silver halide emulsion in order to impart spectral sensitivity to the silver halide emulsion so that the silver halide emulsion exhibits sensitivity to light within a desirable wavelength region. Examples of spectral sensitizing dyes to be used for spectral sensitization in blue, green, and red regions include the dyes described in F. M. Harmer, Heterocyclic compounds—Cyanine dyes and related compounds (John Wiley & Sons [New York, London], 1964). Specific examples of the compounds and spectral sensitizing methods that can be used are those described in JP-A No. 62-215272, page 22, upper right column, to page 38. As a red-sensitive spectral sensitizing dye for silver halide grains having a high silver chloride content, the spectral sensitizing dye described in JP-A No. 3-123340 is very preferable from such standpoints as stability, strength of adsorption, and temperature dependence at exposure.

The amount of the spectral sensitizing dye to be added may vary within a wide range. The amount is preferably in the range of $0.5\times10^{-6}$ to $1.0\times10^{-2}$ moles and more preferably in the range of $1.0\times10^{-6}$ to $5.0\times10^{-3}$ moles per mole of silver halide.

Next, details of the fifth embodiment (silver halide emulsion) of the present invention are given below.

Preferably, the silver halide emulsion of the present invention is made up of cubic or tetradecahedral crystal grains (the grain may have a round apex and may have a plane of a further higher order) or substantially having a {100} plane, octahedral crystal grains, or tabular grains which have an aspect ratio of 2 or more and 50% or more of which total projected area is made up of a {100} plane or {111} plane. The aspect ratio is a value obtained by dividing the equivalent-circle diameter of the projected area of a grain by the grain thickness. In the present invention, cubic grains, tabular grains having a {100} plane as a principal plane, or tabular grains having a {111} plane as a principal plane are preferably employed.

A silver chloroiodide or silver chlorobromoiodide emulsion is used as the silver halide emulsion of the present invention. The silver chloride content is 90 mol % or more. From the standpoint of rapid processability, the silver chloride content is preferably 95 mol % or more and more preferably 97 mol % or more. The silver iodide content is 0.02 to 1 mol %. From the standpoint of exhibiting high sensitivity and high contrast in high illumination intensity exposure, the silver iodide content is preferably 0.05 to 0.50 mol % and more preferably 0.07 to 0.40 mol %. It is preferable that the silver iodide is present near the grain surface.

For the silver halide content in a silver halide emulsion, when the content is indicated by "mol %", the mol % means mol % per total moles of silver element contained in the silver halide emulsion.

When iodide ions are introduced so that the silver halide emulsion of the present invention contains silver iodide, an iodide salt solution may be added singly or an iodide salt solution may be added simultaneously with the addition of a silver salt solution and a chloride-rich salt solution. In the latter case, the iodide salt solution and the chloride-rich salt solution may be added separately or as a mixed solution of the iodide salt and the chloride-rich salt. The iodide salt is added in a form of a soluble salt such as an alkali or alkaline earth metal iodide. Otherwise, an iodide can be introduced by cleaving an organic molecule to obtain an iodide ion as described in U.S. Pat. No. 5,389,508. Alternatively, fine silver iodide grains can be used as an iodide ion source.

The addition of the iodide salt solution may be concentrated on one point of time during the grain formation or may be spread over a certain period of time. The sites into which the iodide ions are introduced in a chloride-rich emulsion grain are limited in order to obtain an emulsion having high sensitivity and producing little fogging. The deeper the introduction site inside the grain interior, the smaller the sensitivity enhancement obtained. Accordingly, the addition of the iodide salt solution is commenced from sites preferably outside at least 50%, more preferably outside at least 70%, and most preferably outside at least 80%, of the grain volume. On the other hand, the addition of the iodide salt solution is completed at sites lying preferably inside at least 98%, most preferably inside at least 96%, of the grain volume. If the addition of the iodide salt solution is completed at sites a little inward from the grain surface, an emulsion having high sensitivity and producing little fogging can be obtained.

The iodide ion concentration distribution in the direction of depth of the grain can be measured by etching/TOF-SIMS (Time of Flight-Secondary Ion Mass Spectrometry) using, for example, a model TRIFT II TOF-SIMS, manufactured by Phi Evans Corp. Details of TOF-SIMS are described in "Surface Analysis Technology Selected Book Secondary Ion Mass Spectrometry" (Hyomen Bunseki Gijutsu Sensho) edited by Japan Surface Science Association, Maruzen Co., Ltd. (1999). When an emulsion grain is analyzed by means of etching/TOF-SIMS, it can be found that iodide ions exude toward the grain surface even if the addition of the iodide salt solution finishes at a site inside the grain. When the grains in the emulsion of the present invention are analyzed for concentration by means of etching/TOF-SIMS, it is preferable that the iodide ion concentration has a maximum on the grain surface and that the iodide ion concentration attenuates toward the grain interior.

It is preferable that the silver halide emulsion of the present invention contains silver bromide so as to exhibit higher sensitivity and contrast in high illumination intensity exposure. Also, the silver bromide content is preferably 0.1 to 7 mol % and more preferably 0.5 to 5 mol %. It is preferable that the silver bromide forms inside or on the silver halide grain a localized phase whose silver bromide content is higher than surrounding regions. The silver bromide content in the localized phase is preferably 5 mol % or more, more preferably 7 to 80 mol %, and most preferably 10 to 60 mol %. The localized phase having a higher silver bromide content may be formed inside the grain or on the surface of the grain in such a manner that the localized phase has the form of layers surrounding the grain. Otherwise, the localized phase may be formed epitaxially at a corner of the grain surface. Alternatively, in the case of a cube or a tabular grain having a {100} plane as a principal plane, the localized phase having a higher silver bromide content may be formed in such a manner that the localized phase covers the {100} plane constituting a principal plane.

The average grain size (i.e., the number average of grain sizes defined by the diameters of the circles equivalent to the projected areas of the grains) of the silver halide grains to be contained in the silver halide emulsion of the present invention is preferably 0.1 to 2 μm. The grain size distribution is preferably a so-called monodispersed distribution whose variation coefficient (i.e., the value obtained by dividing the standard deviation of the grain size distribution by the average grain size) is not more than 20%, preferably not more than 15%, and more preferably not more than 10%. In this case, in order to obtain a broad latitude, it is also preferable to form a single layer using a blend of two or more kinds of the monodispersed emulsions or to form multiple layers.

The silver halide emulsion of the present invention contains iridium. The iridium is doped preferably into the interior and/or the surface of the silver halide grain. It is preferable to dope an iridium complex, and particularly preferable to incorporate a hexacoordinate iridium complex, in which iridium as a central metal has 6 ligands, into a silver halide crystal so that the iridium is uniformly distributed. A preferred example of the iridium complex is a hexacoordinate iridium complex having Cl, Br, or I as a ligand. A hexacoordinate iridium complex in which all of the 6 ligands are made up of Cl, Br, or I is more preferable. In this case, all of Cl, Br, and I may be coexistent in the hexacoordinate iridium complex.

Specific examples of the hexacoordinate iridium complex in which all of the 6 ligands are made up of Cl, Br, or I include $[IrCl_6]^{2-}$, $[IrCl_6]^{3-}$, $[IrBr_6]^{2-}$, $[IrBr_6]^{3-}$, and $[IrI_6]^{3-}$. However, the iridium complexes for use in the present invention are not limited to these examples.

Another preferred example of the iridium complex is a hexacoordinate iridium complex having at least one $H_2O$, O, thiazole, or 5-methylthiazole as a ligand. More preferable is a hexacoordinate iridium complex having at least one $H_2O$, O, thiazole, or 5-methylthiazole as a ligand and having the remaining ligands made up of Cl, Br, or I. Most preferable is a hexacoordinate iridium complex having at least one $H_2O$ or O as a ligand and the remaining ligands made up of Cl, Br, or I.

Specific examples of the hexacoordinate iridium complex having at least one $H_2O$, O, thiazole, or 5-methylthiazole as a ligand and the remaining ligands made up of Cl, Br, or I include $[Ir(H_2O)Cl_5]^{2-}$, $[Ir(H_2O)_2Cl_4]^{-}$, $[Ir(H_2O)Br_5]^{2-}$, $[Ir(H_2O)_2Br_4]^{-}$, $[Ir(O)Cl_5]^{4-}$, $[Ir(O)_2Cl_4]^{5-}$, $[Ir(O)Br_5]^{4-}$, $[Ir(O)_2Br_4]^{5-}$, $[Ir(thiazole)Cl_5]^{2-}$, $[Ir(5\text{-methylthiazole})Cl_5]^{2-}$, $[Ir(thiazole)Br_5]^{2-}$, and $[Ir(thiazole)_2Br_4]^{-}$. However, the iridium complexes for use in the present invention are not limited to the complexes mentioned above.

In the present invention, it is preferable to use singly one or both of a hexacoordinate iridium complex in which all of the 6 ligands are made up of Cl, Br, or I and a hexacoordinate iridium complex having at least one $H_2O$, O, thiazole, or 5-methylthiazole as a ligand and the remaining ligands made up of Cl, Br, or I. However, in order to further enhance the effect of the present invention, it is more preferable to use the hexacoordinate iridium complex in which all of the 6 ligands are made up of Cl, Br, or I together with the hexacoordinate iridium complex having at least one $H_2O$, O, thiazole, or 5-methylthiazole as a ligand and the remaining ligands made up of Cl, Br, or I.

In the case where the iridium complex is an anion and forms a salt with a cation, the counter cation is preferably a water-soluble cation. Preferred specific examples of the cation are alkali metal ions such as a sodium ion, potassium ion, rubidium ion, cesium ion, and lithium ion, ammonium ions, and alkylammonium ions.

The iridium complex can be used by being dissolved in water or in a mixture of water and a water-miscible suitable organic solvent (e.g., an alcohol, an ether, a glycol, a ketone, an ester, or an amide). The amount of the iridium complex to be added is preferably $1\times10^{-10}$ to $1\times10^{-3}$ moles and most preferably $1\times10^{-8}$ to $1\times10^{-5}$ moles per mole of silver during the grain formation of silver halide.

In the present invention, it is possible to incorporate iridium into the silver halide grain by addition of the metal complex or the like directly into the reaction solution at the time of silver halide grain formation or by addition of the iridium complex or the like into the grain-forming reaction solution through the addition of the metal complex or the like into a halide aqueous solution for silver halide grain formation or another solution. It is also possible to incorporate the metal complex into the silver halide grain by carrying out physical ripening using fine grains having the iridium complex or the like incorporated into the grain interior in advance. It is also possible to incorporate the iridium complex or the like into the silver halide grain by a combination of these methods.

Where the iridium complex is incorporated into the silver halide grain, the metal complex may be incorporated uniformly into the grain interior. In addition, it is also preferable to incorporate the metal complex only into the grain surface layer as disclosed in JP-A Nos. 4-208936, 2-125245, and 3-188437. Further, it is also preferable to incorporate the metal complex only into the grain interior and form an additional layer, which does not contain the metal complex, on the grain surface. It is also preferable to modify the grain surface phase by carrying out physical ripening using fine grains having the complex incorporated into grain interior as disclosed in U.S. Pat. Nos. 5,252,451 and 5,256,530. Still further, a combination of these methods may be employed, and plural kinds of the complexes may be incorporated into one silver halide grain. Although the halogen composition of the site at which the complex is incorporated is not particularly limited, the hexacoordinate iridium complex in which all of the 6 ligands are made up of Cl, Br, or I is incorporated preferably into a localized phase having a high silver bromide content, if the silver halide emulsion of the present invention has a localized phase having a high silver bromide content.

In the present invention, the interior and/or surface of the silver halide grain can be doped with a metal ion other than the iridium ion. The metal ion to be used is preferably a transition metal ion. Among the transition metals, iron, ruthenium, osmium, lead, cadmium, and zinc are preferable. Further, it is preferable that the metal ion is accompanied by a ligand and the metal ion is used as a hexacoordinate octahedral complex. If an inorganic compound is to be used as the ligand, it is preferable to use cyanide ions, halide ions, thiocyanate ions, hydroxide ions, peroxide ions, azide ions, nitrite ions, water, ammonia, nitrosyl ions, or thionitrosyl ions. It is also preferable to coordinate any of these ligands with any of the above-mentioned ions of metals, i.e., iron, ruthenium, osmium, lead, cadmium, and zinc. It is also preferable to use plural kinds of ligands in one complex molecule. Further, an organic compound can also be used as the ligand. Preferred examples of the organic compound include a linear compound whose main chain has 5 or less carbon atoms and/or a 5-membered or 6-membered heterocyclic compound. A compound having in the molecule thereof a nitrogen atom, a phosphorus atom, an oxygen atom, or a sulfur atom as an atom coordinating to a metal is more preferable as an organic compound. In this regard, furan, thiophene, oxazole, isoxazole, thiazole, isothiazole, imidazole, pyrazole, triazole, furazane, pyran, pyridine, pyridazine, pyrimidine, and pyrazine are most preferable. Further, a compound which comprises any of the above-mentioned compounds as a skeleton and a substituent introduced thereto is also preferable.

A preferred combination of the metal ion and the ligand is a combination of an iron or ruthenium ion and a cyanide ion. In the present invention, it is preferable that these compounds are used in combination with the iridium complex. In these compounds, it is preferable that the cyanide ions account for the majority of the coordination number of the iron or ruthenium acting as the central metal, such that the remaining coordination sites are occupied by thiocyanate ions, ammonia, water, nitrosyl ions, dimethyl sulfoxide, pyridine, pyrazine, or 4,4'-bipyridine. The most preferred is the formation of a hexacyanoferrate or hexacyanoruthenate complex such that all of the 6 coordination sites of the central metal are occupied by cyanide ions. The amount of the complex that has cyanide ions as ligands and is to be added during the silver halide grain formation is preferably $1\times10^{-8}$ to $1\times10^{-2}$ moles and most preferably $1\times10^{-6}$ to $5\times10^{-4}$ moles per mole of silver. In the case where ruthenium or osmium is used as the central metal, it is also preferable to use a nitrosyl ion, thionitrosyl ion, or water molecule together with a chloride ion as a ligand. More preferable is the formation of a pentachloronitrosyl complex, a pentachlorothionitrosyl complex, or a pentachloroaqua complex. It is also preferable to form a hexachloro complex. The amount of the complex to be added during the silver halide grain formation is preferably $1\times10^{-10}$ to $1\times10^{-6}$ moles and more preferably $1\times10^{-9}$ to $1\times10^{-6}$ moles per mole of silver.

The silver halide emulsion of the present invention is chemically sensitized by a gold sensitizer whose stability constant of gold complex log $\beta_2$ is in the range of 21 to 35. The stability constant of gold complex log $\beta_2$ can be obtained by employing the measuring methods described in Comprehensive Coordination Chemistry, Chapter 55, page 864, 1987, Encyclopedia of Electrochemistry of the Elements, Chapter IV-3, 1975, and Journal of the Royal Netherlands Chemical Society, Vol. 101, p. 164, 1982, or the measuring methods according to references cited in this literature. The value of log $\beta_2$ can be obtained by calculation from the value of gold potential measured under conditions of 25° C., pH 6.0 (adjusted by a potassium dihydrogenphosphate/disodium hydrogenphosphate buffer solution), and an ionic strength of 0.1M(KBr). According to this measuring method, the value of log $\beta_2$ of thiocyanate ions is calculated to be 20.5, which is approximately equal to 20, the value described in the literature (Comprehensive Coordination Chemistry, 1987, Chapter 55, page 864, Table 2).

The gold sensitizer whose stability constant of gold complex log $\beta_2$ is in the range of 21 to 35 is represented preferably by the following general formula (III):

$$\{(L^1)_x(Au)_y(L^2)_z.Q_q\}_p \qquad \text{General formula (III)}$$

In the general formula (III), $L^1$ and $L^2$ each represents a compound whose log $\beta_2$ is in the range of 21 to 35, preferably in the range of 22 to 31, and more preferably in the range of 24 to 28. It is preferable that $L^1$ and $L^2$ each represents a compound having at least one unstable sulfur group capable of reacting with silver halide to produce silver sulfide, a hydantoin compound, a thioether compound, a mesoionic compound, —SR', a heterocyclic compound, a phosphine compound, an amino acid derivative, a sugar derivative, or a thiocyanate group. These may be the same or different. R' represents an aliphatic hydrocarbon group, an aryl group, a heterocyclic group, an acyl group, a carbamoyl group, a thiocarbamoyl group, or a sulfonyl group.

In the general formula (III), Q represents a counter anion or counter cation necessary to neutralize the charge of the compound; x and z each represents an integer of 0 to 4; y and p each represents 1 or 2; and q represents a value, including fractions, in the range of 0 to 1.

Among the compounds represented by the general formula (III), a compound in which $L^1$ and $L^2$ each represents a compound having at least one unstable sulfur group capable of reacting with silver halide to produce silver sulfide, a hydantoin compound, a thioether compound, a mesoionic compound, —SR', a heterocyclic compound, or a phosphine compound and x, y, and z each represents 1 is preferable.

Among the compounds represented by the general formula (III), a compound in which $L^1$ and $L^2$ each represents a compound having at least one unstable sulfur group capable of reacting with silver halide to produce silver sulfide, a mesoionic compound, or —SR' and x, y, z, and p each represents 1 is more preferable.

Examples of the compound represented by $L^1$ or $L^2$ having at least one unstable sulfur group capable of reacting with silver halide to produce silver sulfide include thioketones (e.g., thioureas, thioamides, and rhodanines), thiophosphates, and thiosulfates. Among these compounds, thioketones (preferably thioureas and thioamides) and thiosulfates are preferable.

Examples of the hydantoin compound represented by $L^1$ or $L^2$ include an unsubstituted hydantoin and N-methylhydantoin. Examples of the thioether compound represented by $L^1$ or $L^2$ include a linear or cyclic thioether (e.g., bishydroxyethyl thioether, 3,6-dithia-1,8-octanediol, 1,4,8,11-tetrathiacyclotetradecane, and the like) having 1 to 8 thio groups which are linked together by a substituted or unsubstituted, straight or branched alkylene group (e.g., ethylene, triethylene, and the like) or by a phenylene group. Examples of the mesoionic compound represented by $L^1$ or $L^2$ include mesoionic-3-mercapto-1,2,4-triazoles (e.g., mesoionic-1,4-5-trimethyl-3-mercapto-1,2,4-triazole and the like).

Where $L^1$ and $L^2$ each represents —SR', examples of the aliphatic hydrocarbon group represented by R' include a substituted or unsubstituted, straight or branched alkyl group having 1 to 30 carbon atoms (e.g., methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodiumsulfoethyl, diethylaminoethyl, diethylaminopropyl, butoxypropyl, ethoxyethoxyethyl, or n-hexyloxypropyl), a substituted or unsubstituted cycloalkyl group having 3 to 18 carbon atoms (e.g., cyclopropyl, cyclopentyl, cyclohexyl, cyclooctyl, adamantyl, or cyclododecyl), an alkenyl group having 2 to 16 carbon atoms (e.g., allyl, 2-butenyl, or 3-pentenyl), an alkynyl group having 2 to 10 carbon atoms (e.g., propargyl or 3-pentynyl), and an aralkyl group having 6 to 16 carbon atoms (e.g., benzyl); examples of the aryl group represented by R' include a substituted or unsubstituted phenyl or naphthyl group having 6 to 20 carbon atoms (e.g., unsubstituted phenyl, unsubstituted naphthyl,3,5-dimethylphenyl, 4-butoxyphenyl, 4-dimethylaminophenyl, or 2-carboxyphenyl); examples of the heterocyclic group represented by R' include a substituted or unsubstituted, nitrogen-containing, 5-membered heterocycle (e.g., imidazolyl, 1,2,4-triazolyl, tetrazolyl, oxadiazolyl, thiadiazolyl, benzimidazolyl, or purinyl), a substituted or unsubstituted, nitrogen-containing, 6-membered heterocycle (e.g., pyridyl, piperidyl, 1,3,5-triazino, or 4,6-dimercapto-1,3,5-triazino), furyl, and thienyl; examples of the acyl group represented by R' include acetyl and benzoyl; examples of the carbamoyl group represented by R' include dimethylcarbamoyl; examples of the thiocarbamoyl group represented by R' include diethylthiocarbamoyl; and examples of the sulfonyl group represented by R' include a substituted or unsubstituted alkylsulfonyl group having 1 to 10 carbon atoms (e.g., methanesulfonyl or ethanesulfonyl) and a substituted or unsubstituted phenylsulfonyl group having 6 to 16 carbon atoms (e.g., phenylsulfonyl).

In an —SR' represented by $L^1$ or $L^2$, R' is preferably an aryl or heterocyclic group, more preferably a heterocyclic group, further preferably a 5-membered or 6-membered, nitrogen-containing heterocyclic group, and most preferably a nitrogen-containing heterocyclic group bearing as a substituent a water-soluble group (e.g., a sulfo group, a carboxyl group, a hydroxyl group, or an amino group).

Examples of the heterocyclic compound represented by $L^1$ or $L^2$ include substituted or unsubstituted, nitrogen-containing, 5-membered heterocycles (e.g., pyrroles, imidazoles, pyrazoles, 1,2,3-triazoles, 1,2,4-triazoles, tetrazoles, oxazoles, isoxazoles, isothiazoles, oxadiazoles, thiadiazoles, pyrrolidines, pyrrolines, imidazolidines, imidazolines, pyrazolidines, pyrazolines, and hydantoins), heterocycles containing the above-mentioned 5-membered heterocycles (e.g., indoles, isoindoles, indolizines, indazoles, benzimidazoles, purines, benzotriazoles, carbazoles, tetraazaindenes, benzothiazoles, and indolines), substituted or unsubstituted, nitrogen-containing, 6-membered heterocycles (e.g., pyridines, pyrazines, pyrimidines, pyridazines, triazines, thiadiazines, piperidines, piperazines, and morpholines), heterocycles containing the above-mentioned 6-membered heterocycles (e.g., quinolines, isoquinolines, phthalazines, naphthylidines, quinoxalines, quinazolines, pteridines, phenathylidines, acridines, phenanthrolines, and phenazines), substituted or unsubstituted furans, substituted or unsubstituted thiophenes, and benzothiazoliums.

Examples of the heterocyclic compound represented by $L^1$ or $L^2$ are preferably unsaturated, nitrogen-containing, 5-membered or 6-membered heterocycles, and heterocycles containing these heterocycles, such as pyrroles, imidazoles, pyrazoles, 1,2,4-triazoles, oxadiazoles, thiadiazoles, imidazolines, indoles, indolizines, indazoles, benzimidazoles, purines, benzotriazoles, carbazoles, tetraazaindenes, benzothiazoles, pyridines, pyrazines, pyrimidines, pyridazines, triazines, quinolines, isoquinolines, and phthalazines. In addition, heterocyclic compounds known as fogging-preventive agents in the art (e.g., indazoles, benzimidazoles, benzotriazoles, and tetraazaindenes) are preferable.

Examples of the phosphine compound represented by $L^1$ or $L^2$ are phosphines bearing as a substituent an aliphatic hydrocarbon group having 1 to 30 carbon atoms, an aryl group having 6 to 20 carbon atoms, a heterocyclic group (e.g., pyridyl), a substituted or unsubstituted amino group (e.g., dimethylamino), and/or an alkyloxy group (e.g., methyloxy or ethyloxy), and preferably phosphines bearing as a substituent an alkyl group having 1 to 10 carbon atoms or an aryl group having 6 to 12 carbon atoms (e.g., triphenylphosphine or triethylphosphine).

Further, it is preferable that the mesoionic compound, —SR', and the heterocyclic compound represented by $L^1$ or $L^2$ bear an unstable sulfur group (e.g., thioureido group) capable of reacting with a silver halide to form silver sulfide.

Furthermore, the compounds represented by $L^1$ or $L^2$ in the general formula (III) may bear as many substituents as is possible. Examples of the substituents include a halogen atom (e.g., fluorine atom, chlorine atom, or bromine atom), an aliphatic hydrocarbon group (e.g., methyl, ethyl, isopropyl, n-propyl, t-butyl, n-octyl, cyclopentyl, or cyclohexyl), an alkenyl group (e.g., allyl, 2-butenyl, or 3-pentenyl), an alkynyl group (e.g., propargyl or 3-pentynyl), an aralkyl group (e.g., benzyl or phenethyl), an aryl group (e.g., phenyl, naphthyl, or 4-methylphenyl), a heterocyclic group (e.g., pyridyl, furyl, imidazolyl, piperidinyl, or morpholyl), an alkyloxy group (e.g., methoxy, ethoxy, butoxy, 2-ethylhexyloxy, ethoxyethoxy, or methoxyethoxy), an aryloxy group (e.g., phenoxy or 2-naphthyloxy), an amino group (e.g., unsubstituted amino, dimethylamino, diethylamino, dipropylamino, dibutylamino, ethylamino, dibenzylamino, or anilino), an acylamino group (e.g., acetylamino or benzoylamino), a ureido group (e.g., unsubstituted ureido, N-methylureido, or N-phenylureido), a thioureido group (e.g., unsubstituted thioureido, N-methylthioureido, or N-phenylthioureido), a selenoureido group (e.g., unsubstituted selenoureido, a phosphineselenide group (e.g., diphenylphosphineselenide), a telluroureido group (e.g., unsubstituted telluroureido), a urethane group (e.g., methoxycarbonylamino or phenoxycarbonylamino), a sulfonamide group (e.g., methylsulfonamide or phenylsulfonamide), a sulfamoyl group (e.g., unsubstituted sulfamoyl, N,N-dimethylsulfamoyl, or N-phenylsulfamoyl), a carbamoyl group (e.g., unsubstituted carbamoyl, N,N-diethylcarbamoyl, or N-phenylcarbamoyl), a sulfonyl group (e.g., methanesulfonyl or p-toluenesulfonyl), a sulfinyl group (e.g., methylsulfinyl or phenylsulfinyl), an alkyloxycarbonyl group (e.g., methoxycarbonyl or ethoxycarbonyl), an aryloxycarbonyl group (e.g., phenoxycarbonyl), an acyl group (e.g., acetyl, benzoyl, formyl, or pivaloyl), an acyloxy group (e.g., acetoxy or benzoyloxy), a phosphoric acid amide group (e.g., N-diethyl phosphoric acid amide), an alkylthio group (e.g., methylthio or ethylthio), an arylthio group (e.g., phenylthio), a cyano group, a sulfo group, a thiosulfonic acid group, a sulfinic acid group, a carboxyl group, a hydroxyl group, a mercapto group, a phosphono group, a nitro group, a sulfino group, an ammonio group (e.g., trimethyl ammonio), a phosphonio group, a hydrazino group, a thiazolino group, and a silyloxy group (e.g., t-butyldimethylsilyloxy or t-butyldiphenylsilyloxy). If two or more substituents are present, these substituents may be the same or different.

Examples of the counter anion represented by Q in the general formula (III) include a halogenium ion (e.g., $F^-$, $Cl^-$, $Br^-$, or $I^-$), a tetrafluoroborate ion ($BF_4^-$), a hexafluorophosphate ion ($PF_6^-$), a sulfate ion ($S_2O_4^{2-}$), an arylsulfonate ion (e.g., a p-toluenesulfonate ion or naphthalene-2,5-disulfonate ion), and a carboxy ion (e.g., an acetate ion, trifluoroacetate ion, oxalate ion, or benzoate ion). Examples of the counter cation represented by Q include an alkali metal ion (e.g., a lithium ion, sodium ion, potassium ion, rubidium ion, or cesium ion), an alkaline earth metal ion (e.g., a magnesium ion or calcium ion), a substituted or unsubstituted ammonium ion (e.g., an unsubstituted ammonium ion, triethylammonium ion, or tetramethylammonium ion), a substituted or unsubstituted pyridinium ion (e.g., an unsubstituted pyridinium ion or 4-phenylpyridinium ion), and a proton. q is the number of Qs necessary for neutralization of the charge of the compound and represents a value in the range of 0 to 1, including fractions.

The counter anion represented by Q is preferably a halogenium ion (e.g., $Cl^-$ or $Br^-$), a tetrafluoroborate ion, a hexafluorophosphate ion, or a sulfate ion. The counter cation represented by Q is preferably an alkali metal ion (e.g., a sodium ion, potassium ion, rubidium ion, or cesium ion), a substituted or an unsubstituted ammonium ion (e.g., an unsubstituted ammonium ion, triethylammonium ion, or tetramethylammonium ion), or a proton.

Specific examples of the compound represented by $L^1$ or $L^2$ in the general formula (III) (exemplary compounds L-1 to 17) are given below. However, it should be noted that the compounds for use in the present invention are not limited to these exemplary compounds. The numeral in the brackets indicates the value of log $\beta_2$.

(L-1)

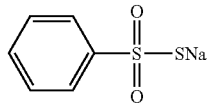

(22)

(L-2)

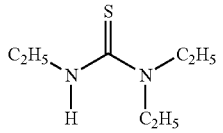

(24)

-continued
(L-3)
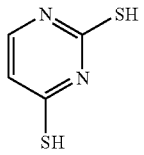
(25)
(L-4)
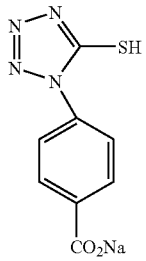
(25)
(L-5)
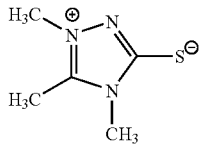
(26)
(L-6)
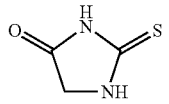
(27)
(L-7)
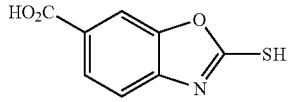
(27)
(L-8)
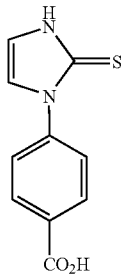
(27)
(L-9)
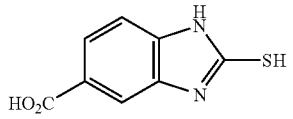
(27)
-continued
(L-10)
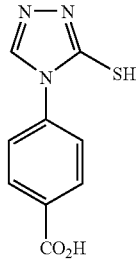
(27)
(L-11)
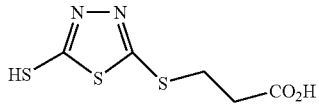
(27)
(L-12)
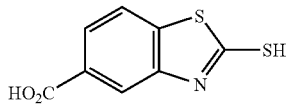
(27)
(L-13)
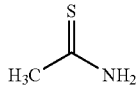
(28)
(L-14)
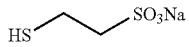
(28)
(L-15)
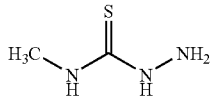
(29)
(L-16)
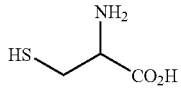
(29)
(L-17)
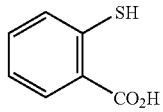
(30)
The compounds represented by the general formula (III) can be synthesized with reference to conventionally known methods such as those described in, for example, INORG. NUCL. CHEM. LETTERS, VOL. 10, page 641, 1974), Transition Met. Chem. 1, page 248, 1976), Acta. Cryst. B32, page 3321, 1976), JP-A No. 8-69075, JP-B No. 45-8831, European Patent No. 915371A1, JP-A No. 6-11788, JP-A No. 6-501789, JP-A No. 4-267249, and JP-A No. 9-118685.

Specific examples of the compound represented by the general formula (III) are given below. However, it should be noted that the gold sensitizers for use in the present invention are not limited to these exemplary compounds.
(S-1)
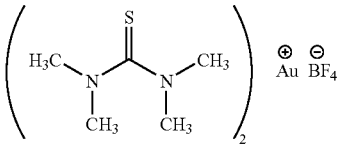
(S-2)
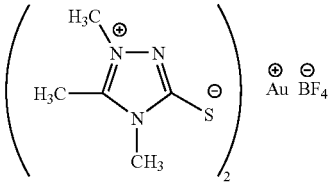
(S-3)
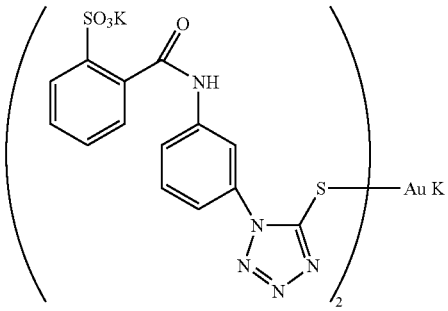
(S-4)
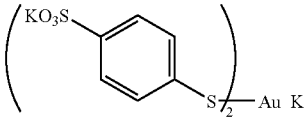
(S-5)
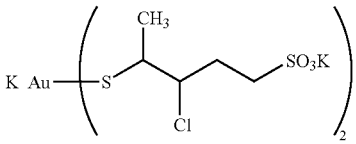
(S-6)
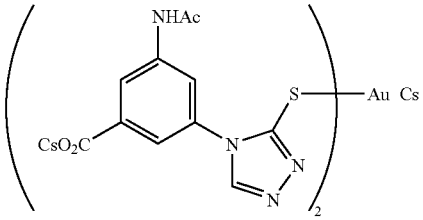
(S-7)
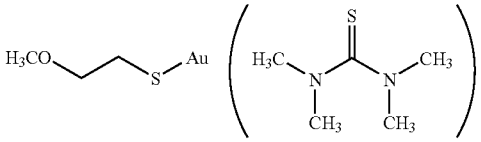
-continued
(S-8)
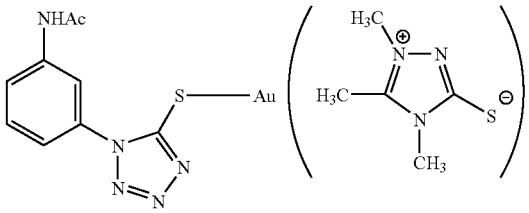
(S-9)
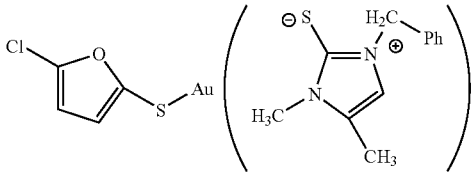
(S-10)
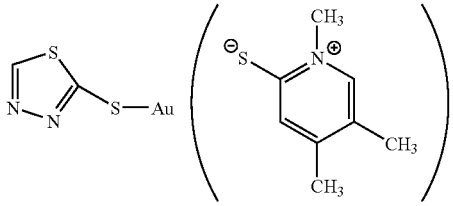
(S-11)
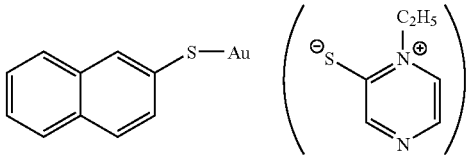
(S-12)
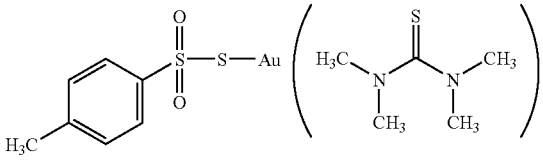
(S-13)
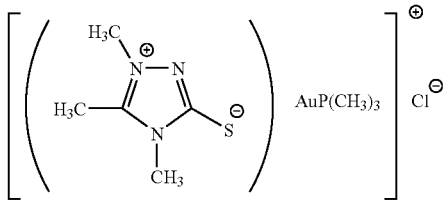
(S-14)
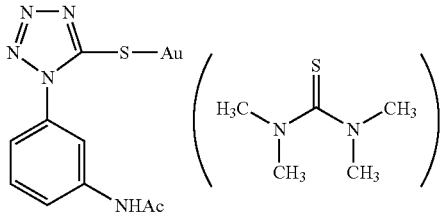
(S-15)
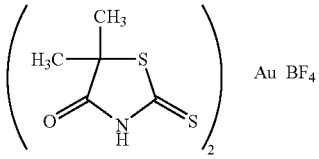

-continued (S-16)

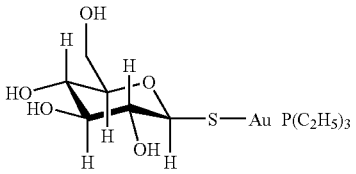

(S-17)

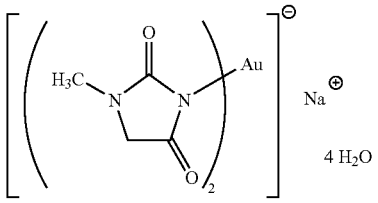

(S-18)

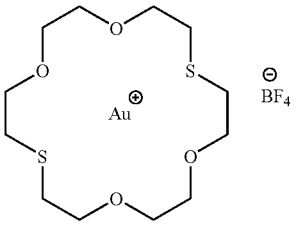

(S-19)

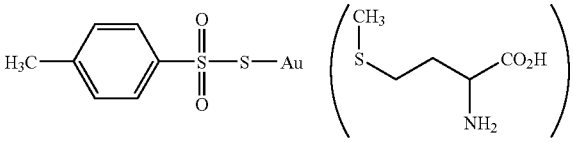

The gold-sensitization by the gold sensitizer is normally carried out by adding the gold sensitizer to the silver halide emulsion and stirring the mixture at a high temperature (preferably 40° C. or higher) for a certain period of time. Although the amount of the gold sensitizer to be added varies depending on various conditions, a preferred amount to be added is approximately equivalent to a number of moles of gold in the range of $1\times10^{-7}$ to $1\times10^{-4}$ moles per mole of silver.

As the gold sensitizer, besides the compounds represented by the general formula (III), commonly used gold compounds (e.g., chloroauric acid, potassium chloroaurate, auric trichloride, potassium auricthiocyanate, potassium iodoaurate, tetracyanoauric acid, ammonium aurothiocyanate, and pyridyl trichlorogold) and gold sulfide colloids may also be used. These compounds may be used in combination with the compounds represented by the general formula (III).

The silver halide emulsion for use in the present invention can be chemically sensitized by conducting gold sensitization in combination with other chemical sensitizing methods. Examples of the chemical sensitizing methods that can be employed in combination with the gold sensitization include sulfur sensitization, selenium sensitization, tellurium sensitization, noble metal sensitization using a metal other than gold, and reduction sensitization. The compounds that are preferably used for the chemical sensitization are the compounds described in JP-A No. 62-215272, lower right column on page 18 to upper right column on page 22.

Next, sixth to eleventh embodiments (silver halide color photographic photosensitive materials and image-forming methods) of the present invention are explained.

The silver halide color photographic photosensitive material (hereinafter, occasionally referred to simply as "photosensitive material") includes a support having disposed thereon at least one blue-sensitive silver halide emulsion layer, at least one green-sensitive silver halide emulsion layer, and at least one red-sensitive silver halide emulsion layer. At least one of the blue-sensitive silver halide emulsion layer, the green-sensitive silver halide emulsion layer, and the red-sensitive silver halide emulsion layer contains a silver halide emulsion according to the first or second embodiment of the present invention. At least one layer is required to contain a silver halide emulsion according to the present invention, and other layers may use a silver halide emulsion chemically sensitized by a conventional method. Examples of the conventional chemical sensitizing method that can be employed include sulfur sensitization, characterized by the addition of an unstable sulfur compound, noble metal sensitization, represented by gold sensitization, and reduction sensitization. These methods may be employed singly or in combination. The compounds that are preferably used for the chemical sensitization are the compounds described in JP-A No. 62-215272, lower right column on page 18 to upper right column on page 22.

If desired, besides the blue-sensitive silver halide emulsion layer, green-sensitive silver halide emulsion layer, and red-sensitive silver halide emulsion layer, the photosensitive material of the present invention may have a hydrophilic colloid layer, an antihalation layer, an interlayer, and a colored layer, which are described later. Further, the photosensitive material of the present invention has at least one color-developing layer capable of developing a color by light irradiation or development processing. Furthermore, by the formation of color-developing layers capable of developing a magenta color, a yellow color, and a cyan color, respectively, the photosensitive material of the present invention can be made into a photosensitive material capable of forming a full-color image. The color-developing layers may be the blue-sensitive silver halide emulsion layer, the green-sensitive silver halide emulsion layer, and the red-sensitive silver halide emulsion layer.

Further, the photosensitive material of the present invention may include a support having disposed thereon at least one silver halide emulsion layer containing a yellow dye-forming coupler, at least one silver halide emulsion layer containing a magenta dye-forming coupler, and at least one silver halide emulsion layer containing a cyan dye-forming coupler. At least one of the silver halide layers contains a silver halide emulsion which includes an iridium-doped silver chloroiodide or silver chlorobromoiodide having a silver chloride of 90 mol % or more and a silver iodide content in the range of 0.02 to 1 mol % and is chemically sensitized by a gold sensitizer whose stability constant of gold complex log $\beta_2$ is in the range of 21 to 35. In the present invention, the silver halide emulsion layer containing a yellow dye-forming coupler functions as a yellow-developing layer, the silver halide emulsion layer containing a magenta dye-forming coupler functions as a magenta-developing layer, and the silver halide emulsion layer containing a cyan dye-forming coupler functions as a cyan-developing layer. It is preferable that the silver halide emulsions contained in the yellow-developing layer, the magenta-developing layer, and the cyan-developing layer are sensitive to light falling in different wavelength regions (e.g., light in the blue region, light in the green region, and light in the red region).

If desired, besides the yellow-developing layer, the magenta-developing layer, and the cyan-developing layer, the photosensitive material of the present invention may have a hydrophilic colloid layer, an antihalation layer, an interlayer, and a colored layer, which are described later.

Conventionally known photographic materials and additives can be used in the photosensitive material of the present invention.

For example, a transmissive support or a reflective support can be used as the support. As a transmissive support, preferably used are a transparent film such as a cellulose nitrate film or a polyethylene terephthalate film and a polyester support which is made from, for example, 2,6-naphthalenedicarboxylic acid (NDCA) and ethylene glycol (EG) or from NDCA, terephthalic acid, and EG, and which has an information recording layer such as a magnetic layer. As a reflective support, particularly preferable is a reflective support laminated with plural layers of polyethylene layers or polyester layers such that at least one of these waterproof resin layers (laminate layers) contains a white pigment such as titanium oxide.

A more preferable reflective support used in the present invention is a support on which a polyolefin layer having fine pores has been provided on one face of the paper base bearing the silver halide emulsion layer. The polyolefin layer may have a multilayer construction in which preferably a polyolefin layer next to a gelatin layer on the face bearing the silver halide emulsion layer does not have the fine pores (for example, a polyolefin layer made from polypropylene or polyethylene) and a polyolefin layer having the fine pores is at the site closer to the paper base (for example, a polyolefin layer made from polypropylene or polyethylene). The density of the polyolefin layer, which lies between the paper base and a photographic constituent layer and may have a multilayer or single-layer construction, is preferably 0.40 to 1.0 g/mL and more preferably 0.50 to 0.70 g/mL. The thickness of the polyolefin layer, which lies between the paper base and a photographic constituent layer and may have a multilayer or single-layer construction, is preferably 10 to 100 μm and more preferably 15 to 70 μm. A thickness ratio of the polyolefin layer to the paper base is preferably. 0.05 to 0.2 and more preferably 0.1 to 0.15.

From the standpoint of enhancing the rigidity of the reflective support, it is also preferable to provide a polyolefin layer on the reverse face (i.e., back), which is opposite to the photographic constituent layer face, of the paper base. In this case, the polyolefin layer on the back is preferably a polypropylene or polyethylene layer having a matte surface and more preferably a polypropylene layer having a matte surface. The thickness of the polyolefin layer on the back is preferably 5 to 50 μm and more preferably 10 to 30 μm. The density of the polyolefin layer on the back is preferably 0.7 to 1.1 g/mL. Preferred modes of the polyolefin layer to be provided on the paper base of the reflective support of the present invention are described in, for example, JP-A No. 10-333277, 10-333278, 11-52513, and 11-65024, EP0880065, and EP0880066.

It is preferable that the waterproof resin layer contains a fluorescent brightener. Alternatively, a hydrophilic colloid layer, in which the fluorescent brightener is dispersed, may be formed separately. The fluorescent brightener may be benzoxazole-based, coumarin-based, or pyrazoline-based. Preferably, the fluorescent brightener is a benzoxazolylnaphthalene-based or benzoxazolylstilbene-based fluorescent brightener. The amount of the fluorescent brightener to be included is preferably 1 to 100 mg/m$^2$, although the amount is not particularly limited. When the fluorescent brightener is mixed into the waterproof resin, the proportion of the fluorescent brightener is preferably 0.0005 to 3% by mass, more preferably 0.01 to 0.5% by mass, relative to the resin.

The reflective support may be formed by providing a hydrophilic colloid layer containing a white pigment on the transmissive support or reflective support described above. The reflective support may be a support having a metal surface exhibiting mirror reflectivity or secondary diffuse reflectivity.

The support for use in the photosensitive material of the present invention may be a white polyester-based support or a support having on the silver halide emulsion layer face a layer containing a white pigment, for use as a display. In order to enhance image sharpness, it is preferable to provide an antihalation layer on the silver halide emulsion layer face or on the back face of the support. In particular, it is preferable to set the transmission density of the support to a value within the range of 0.35 to 0.8 so that the display can use both reflected light and transmitted light.

For the purpose of enhancing image sharpness, a dye (among others, an oxonol-base dye) that can be decolorized by a treatment and is described in European Patent EP0, 337,490A2, pages 27-76 is preferably incorporated into the hydrophilic colloid layer of the photosensitive material of the present invention, such that the optical reflection density of the photosensitive material becomes 0.70 or more at 680 nm. Alternatively, 12% by mass or more (more preferably 14% by mass or more) of titanium oxide which has been surface-treated with a dihydric to tetrahydric alcohol (e.g., trimethylolethane) or the like is preferably incorporated into the waterproof resin layer of the support.

For the purpose of preventing irradiation or halation or of enhancing safelight safety, a dye (among others, an oxonol-base dye or a cyanine dye) that can be decolorized by a treatment and is described in European Patent EP0,337, 490A2, pages 27-76 is preferably incorporated into the hydrophilic colloid layer of the photosensitive material of the present invention. Further, a dye described in European Patent EP0819977 may also be advantageously added to the photosensitive material of the present invention.

Some of these dyes will adversely affect color separation or safelight safety if the amount used is increased. The water-soluble dyes described in JP-A No. 5-127324, 5-127325, and 5-216185 are preferable as dyes that can be used without causing undesirable effects on color separation.

In the present invention, in place of the water-soluble dye or in combination with the water-soluble dye, a colored layer that can be decolorized by a treatment is used. The colored layer that can be decolorized by a treatment may be in direct contact with a layer containing a silver halide emulsion or may be in indirect contact with the layer containing the silver halide emulsion via an interlayer containing a color-mixing inhibitor for processing, such as gelatin or hydroquinone. Preferably, the colored layer is provided as an underlayer (on the support side) of the emulsion layer that is designed to develop the same kind of primary color as the colored layer. Colored layers corresponding to all primary colors may be provided, or colored layers corresponding to freely selected primary colors may be provided. Alternatively, it is possible to provide a colored layer colored in compliance with plural primary color regions. The optical reflection density of the colored layer is set such that a value of optical density is preferably in the range of 0.2 to 3.0, more preferably in the range of 0.5 to 2.5, and particularly preferably in the range of 0.8 to 2.0, at a wavelength which is within a wavelength region to be used for exposure (in a visible light region of 400 to 700 nm for exposure by an ordinary printer, and at the wavelength of the light source for scanning exposure in the case of scanning exposure) and causes the highest optical density.

For the formation of the colored layer, conventionally known methods may be employed. Examples of methods include a method in which a dispersion of solid particles of dye, such as the dye described in JP-A No. 2-282244, upper right column on page 3 to page 8, or the dye described in JP-A No. 3-7931, upper right column on page 3 to lower left column on page 11, is incorporated into a hydrophilic colloid layer; a method in which an anionic dye is mordanted to a cationic polymer; a method in which a dye is immobilized inside a layer by being adsorbed on fine particles such as silver halide grains; and a method in which colloidal silver is used as described in JP-A No. 1-239544. As for the method of dispersing fine particles of a dye in a solid state, for example, a method in which fine dye particles substantially insoluble at least at pH 6 or less in water but substantially soluble at least at pH 8 or more in water are incorporated is described in JP-A No. 2-308244, pages 4 to 13. For example, a method in which an anionic dye is mordanted to a cationic polymer is described in JP-A No. 2-84637, pages 18 to 26. A method of preparing colloidal silver as a light-absorber is described in U.S. Pat. Nos. 2,688,601 and 3,459,563. Among these methods, the method in which fine dye particles are incorporated and the method in which colloidal silver is used are preferable.

Although the photosensitive material of the present invention may be used for a color negative film, a color positive film, a color reversal film, a color reversal photographic paper, a color photographic paper, or the like, the photosensitive material of the present invention is preferably used for a color photographic paper.

The color photographic paper preferably has at least one yellow-developing silver halide emulsion layer, at least one magenta-developing silver halide emulsion layer, and at least one cyan-developing silver halide emulsion layer. Usually, the order of the silver halide emulsion layers from the support side is the yellow-developing silver halide emulsion layer, the magenta-developing silver halide emulsion layer, and the cyan-developing silver halide emulsion layer. However, a layer construction different from this construction is also possible. Although a silver halide emulsion layer containing a yellow coupler may be provided at any position on the support, the yellow coupler-containing layer is disposed preferably at a position more distant from the support than at least one of the magenta coupler-containing silver halide emulsion layer and the cyan coupler-containing silver halide emulsion layer, if the yellow coupler-containing layer contains silver halide tabular grains. Further, from the standpoints of accelerating color development, promoting desilverization, and reducing residual color due to sensitizing dyes, the yellow coupler-containing layer is disposed preferably at a position remotest from the support, relative to the other silver halide emulsion layers. Meanwhile, the cyan coupler-containing silver halide emulsion layer preferably constitutes a central layer among the other silver halide emulsion layers from the standpoint of reducing Blix discoloration; and the cyan coupler-containing silver halide emulsion layer preferably constitutes the lowest layer from the standpoint of reducing discoloration by light. Further, the yellow-developing silver halide emulsion layer, the magenta-developing silver halide emulsion layer, and the cyan-developing silver halide emulsion layer may each be made up of 2 or 3 layers. For example, as described in JP-A Nos. 4-75055, 9-114035, and 10-246940, and U.S. Pat. No. 5,576,159, it is also preferable to provide a coupler layer containing no silver halide emulsion in a position next to a silver halide emulsion layer for use as a color developing layer.

The silver halide emulsions and other materials (such as additives) and photographic constituent layers (layer construction) that can be employed in the present invention, as well as processing methods and processing additives to be employed for processing of the photosensitive material, are preferably those described in JP-A Nos. 62-215272 and 2-33144 and European Patent EP0,355,660A2, and particularly those described in European Patent EP0,355,660A2. Further, the silver halide color photographic materials and processing methods therefor described in JP-A Nos. 5-34889, 4-359249, 4-313753, 4-270344, 5-66527, 4-34548, 4-145433, 2-854, 1-158431, 2-90145, 3-194539, and 2-93641, Laid-Open European Patent EP0,520,457A2 and others are also preferable.

In particular, in the present invention, the reflective support, silver halide emulsions, kinds of different metal ions to be doped into the silver halide emulsion grains, storage stabilizers or fogging inhibitors of silver halide emulsions, chemical sensitization methods (chemical sensitizers), spectral sensitization methods (spectral sensitizers), cyan, magenta, and yellow couplers and methods of emulsifying and dispersing the couplers, color image stability improving agents (stain inhibitors, browning inhibitors, etc.), dyes (colorants), kinds of gelatin, layer constructions of photosensitive materials, pH of the coating layers of photosensitive materials, and others, each described in the patents shown in the following table, can be preferably used.

TABLE 1

| Elements | JP-A-7-104448 | JP-A-7-77775 | JP-A-7-301895 |
|---|---|---|---|
| Reflective support | Col. 7, line 12 to col. 12, line 19 | Col. 35, line 43 to col. 44, line 1 | Col. 5, line 40 to col. 9, line 26 |
| Silver halide emulsions | Col. 72, line 29 to col. 74, line 18 | Col. 44, line 36 to col. 46, line 29 | Col. 77, line 48 to col. 80, line 28 |
| Kinds of different metal ions | Col. 74, line 19 to line 44 | Col. 46, line 30 to col. 47, line 5 | Col. 80, line 29 to col. 81, line 6 |
| Storage stabilizers or fogging inhibitors | Col. 75, line 9 to line 18 | Col. 47, line 20 to line 29 | Col. 18, line 11 to col. 31, line 37 (particularly mercaptohetero-cyclic compound) |
| Chemical sensitization method (chemical sensitizers) | Col. 74, line 45 to col. 75, line 6 | Col. 47, line 7 to line 17 | Col. 81, line 9 to line 17 |
| Spectral sensitization | Col. 75, line 19 | Col. 47, line 30 | Col. 81, line 21 |

TABLE 1-continued

| Elements | JP-A-7-104448 | JP-A-7-77775 | JP-A-7-301895 |
|---|---|---|---|
| method (spectral sensitizers) | to col. 76, line 45 | to col. 49, line 6 | to col. 82, line 48 |
| Cyan couplers | Col. 12, line 20 to col. 39, line 49 | Col. 62, line 50 to col. 63, line 16 | Col. 88, line 49 to col. 89, line 16 |
| Yellow couplers | Col. 87, line 40 to col. 88, line 3 | Col. 63, line 17 to line 30 | Col. 89, line 17 to line 30 |
| Magenta couplers | Col. 88, line 4 to line 18 | Col. 63, line 3 to col. 64, line 11 | Col. 31, line 34 to col. 77, line 44 and col. 88, line 32 to line 46 |
| Method of emulsifying and dispersing the couplers | Col. 71, line 3 to col. 72, line 11 | Col. 61, line 36 to line 49 | Col. 87, line 35 to line 48 |
| Color image stability improving agents (stain inhibitors) | Col. 39, line 50 to col. 70, line 9 | Col. 61, line 50 to col. 62, line 49 | Col. 87, line 49 to col. 88, line 48 |
| Browning inhibitors | Col. 70, line 10 to col. 71, line 2 | | |
| Dyes (colorants) | Col. 77, line 42 to col. 78, line 41 | Col. 7, line 14 to col. 19, line 42 & col. 50, line 3 to col. 51, line 14 | Col. 9, line 27 to col. 18, line 10 |
| Kinds of gelatin | Col. 78, line 42 to line 48 | Col. 51, line 15 to line 20 | Col. 83, line 13 to line 19 |
| Layer constructions of photosensitive materials | Col. 39, line 11 to line 26 | Col. 44, line 2 to line 35 | Col. 31, line 38 to col. 32, line 33 |
| pH of the coating films of photosensitive materials | Col. 72, line 12 to line 28 | | |
| Scanning exposure | Col. 76, line 6 to col. 77, line 41 | Col. 49, line 7 to col. 50, line 2 | Col. 82, line 49 to col. 83, line 12 |
| Preservatives in developing solutions | Col. 88, line 19 to col. 89, line 22 | | |

In addition, the couplers described in JP-A No. 62-215272, upper right column, line 4, on page 91 to upper left column, line 6, on page 121, JP-A No. 2-33144, upper right column, line 14, on page 3 to upper left column, bottom line, on page 18, and upper right column, line 6, on page 30 to lower right column, line 11, on page 35, and EP0355, 660A2, lines 15-27, on page 4, line 30 on page 5 to bottom line on page 28, lines 29-31 on page 45, and line 23 on page 47 to line 50 on page 63, are also useful as the cyan, magenta, and yellow couplers for use in the present invention.

Further, the compounds represented by the general formula (II) or (III) in WO-98/33760 and the compounds represented by the general formula (D) in JP-A No. 10-221825 may be advantageously added in the present invention.

As cyan dye-forming couplers (hereinafter, occasionally referred to simply as "cyan couplers") that can be used in the present invention, pyrrolotriazole-based couplers are preferably used. Particularly preferable are the couplers represented by the general formula (I) or (II) in JP-A No. 5-313324, the couplers represented by the general formula (I) in JP-A No. 6-347960, and the exemplary couplers described in these patents. Further, phenol-based cyan couplers and naphthol-based cyan couplers are also preferable. For example, the cyan couplers represented by the general formula (ADF) described in JP-A No. 10-333297 are preferable. As cyan couplers other than those described above, also preferable are pyrroloazole-type cyan couplers described in European Patent EP0488248 and European Patent EP0491197A1, 2,5-diacylaminophenol couplers described in U.S. Pat. No. 5,888,716, pyrroloazole-type cyan couplers having an electron-withdrawing or hydrogen bonding group at a 6-position described in U.S. Pat. Nos. 4,873,183 and 4,916,051, and particularly pyrroloazole-type cyan couplers having a carbamoyl group at a 6-position described in JP-A Nos. 8-171185, 8-311360, and 8-339060.

In addition to the diphenylimidazole-based cyan couplers described in JP-A No. 2-33144, also usable are 3-hydroxypyridine-based cyan couplers described in European Patent EP0,333,185A2 (a 2-equivalent coupler made from an exemplary coupler (42) by providing a chlorine leaving-group to a 4-equivalent coupler (6), and a coupler (9) are particularly preferable among the couplers listed as examples), cyclic active methylene-based cyan couplers described in JP-A No. 64-32260 (exemplary couplers 3, 8, and 34 are particularly preferable among these couplers), pyrrolopyrazole-type cyan couplers described in European Patent EP0,456,226A1, and pyrroloimidazole-type cyan couplers described in European Patent EP0,484,909.

Among these cyan couplers, the pyrroloazole-type cyan couplers represented by the general formula (I) described in JP-A No. 11-282138 are particularly preferable. The descriptions in the above-mentioned patent, paragraphs 0012 to 0059, including the exemplary cyan couplers (1) to (47), are all applicable to the present invention and preferably incorporated herein as a part hereof.

As magenta dye forming couplers (hereinafter, occasionally referred to simply as "magenta couplers") for use in the present invention, 5-pyrazolone-based magenta couplers or pyrazoloazole-based magenta couplers as described in known literatures listed in table 1 above are used. Among these couplers, preferable are a pyrazolotriazole coupler which has a secondary or tertiary alkyl group linked directly to a 2-, 3-, or 6-position of the pyrazolotriazole ring as described in JP-A No. 61-65245, a pyrazoloazole coupler which has a sulfonamide group in the molecule as described in JP-A No. 61-65246, a pyrazoloazole coupler which has an alkoxyphenylsulfonamide ballast group as described in JP-A No. 61-147254, and a pyrazoloazole coupler which has an alkoxy group or aryloxy group at a 6-position as described in European Patent Nos. 226,849A and 294,785A. The pyrazoloazole couplers represented by the general formula (M-1) described in JP-A No. 8-122984 are particularly preferable magenta couplers. The description in the above-mentioned patent, paragraphs 0009 to 0026, is all applicable to the present invention and incorporated herein as a part hereof. In addition, the pyrazoloazole couplers, which have sterically hindering groups at both a 3-position and a 6-position as described in European Patent Nos. 854,384 and 884,640, are also preferably used.

As yellow dye forming couplers (hereinafter, occasionally referred to simply as "yellow couplers") for use in the present invention, preferred examples include, besides the compounds listed in table 1 above, acylacetamide-type yellow couplers which have a 3- to 5-membered cyclic structure in the acyl group as described in European Patent EP0,447,969A1, malondianilide-type yellow couplers having a cyclic structure described in European Patent EP0, 482,552A1, pyrrole-2 or 3-yl or indole-2 or 3-yl carbonylacetanilide-based couplers described in European Patent Laid-Open Nos. 953,870A1, 953,871A1, 953,872A1, 953, 873A1, 953,874A1, 953,875A1, etc., and acylacetamide-type yellow couplers having a dioxane structure described in U.S. Pat. No. 5,118,599. Among these couplers, the use of an acylacetamide-type yellow coupler whose acyl group is a 1-alkylcyclopropane-1-carbonyl group or a malondianilide-type yellow coupler in which one of the anilides constitutes an indoline ring is particularly preferable. These couplers may be used singly or in combination.

It is preferable that the coupler to be used in the present invention is impregnated with a loadable latex polymer (described, for example, in U.S. Pat. No. 4,203,716) in the presence (or in the absence) of a high-boiling point organic solvent listed in table 1 above or is dissolved in a polymer insoluble in water but soluble in an organic solvent and that thereafter the coupler is emulsified and dispersed in a hydrophilic colloid aqueous solution. Examples of the polymer which is insoluble in water but soluble in an organic solvent include the homopolymers and copolymers described in U.S. Pat. No. 4,857,449, columns 7-15, and International Laid-Open Patent WO88/00723, pages 12-30. The use of a methacrylate-based or acrylamide-based polymer, in particular an acrylamide-based polymer, is preferable in view of color image stability, etc.

Conventionally known color mixing inhibitors can be used in the present invention. Color mixing inhibitors preferable for use in the present invention are those described in the patents listed below.

Examples of the color mixing inhibitors include the redox compounds described in JP-A No. 5-333501, phenidone or hydrazine-based compounds described in WO98/33760 and U.S. Pat. No. 4,923,787, and white couplers described in JP-A Nos. 5-249637 and 10-282615, German Patent No. 19,629,142A1, etc. Particularly when raising the pH value of the developing solution to accelerate development processing, it is also preferable to use redox compounds described in German Patent No. 19,618,786A1, European Patent No. 839,623A1, European Patent No. 842,975A1, German Patent No. 19,806,846A1, French Patent No. 2,760,460A1, etc.

In the present invention, it is preferable to use a compound which has a triazine skeleton having a high molar absorption coefficient as a UV absorbing agent. For example, the compounds described in the following patents can be used. These compounds are added preferably to a photosensitive layer and/or a non-photosensitive layer. For example, compounds that can be used are those described in JP-A Nos. 46-3335, 55-152776, 5-197074, 5-232630, 5-307232, 6-211813, 8-53427, 8-234364, 8-239368, 9-31067, 10-115898, 10-147577, and 10-182621, German Patent No. 19,739,797A, European Patent No. 711,804A, Japanese National Publication No. 8-501291, etc.

Although gelatin is advantageously used as a binder or protective colloid usable in the photosensitive materials according to the present invention, a hydrophilic colloid other than gelatin can be used singly or in combination with gelatin. The content of heavy metals, such as iron, copper, zinc, and manganese, as impurities in the gelatin that is preferable for use in the present invention is preferably 5 ppm or less and more preferably 3 ppm or less. Calcium content in the photosensitive material is preferably 20 mg/m$^2$ or less, more preferably 10 mg/m$^2$ or less, and most preferably 5 mg/m$^2$ or less.

In the present invention, in order to inhibit the growth of fungi and bacteria in the hydrophilic colloid layer, which causes deterioration of the images, it is preferable to add various fungicides and bactericides such as those described in JP-A Nos. 63-271247. The pH value of the coating film of the photosensitive material is preferably 4.0 to 7.0 and more preferably 4.0 to 6.5.

In the present invention, for the purposes of enhancing coating stability, preventing generation of static electricity, and controlling the amount of electric charge, a surfactant may be added to the photosensitive material. Kinds of the surfactant include an anionic surfactant, a cationic surfactant, a betaine-based surfactant, and a nonionic surfactant. These are described, for example, in JP-A No. 5-333492. A fluorine-containing surfactant is preferable as a surfactant for use in the present invention. In particular, a fluorine-containing surfactant may be advantageously used. Although fluorine-containing surfactants may be used singly or in combination with conventionally known other surfactants, preferably the fluorine-containing surfactants are used in combination with conventionally known other surfactants. The amount of the surfactants to be added to the photosensitive material is normally $1\times10^{-5}$ to 1 g/m$^2$, preferably $1\times10^{-4}$ to $1\times10^{-1}$ g/m$^2$, and more preferably $1\times10^{-3}$ to $1\times10^{-2}$ g/m$^2$ but is not necessarily limited thereto.

The photosensitive material of the present invention can form images by a process including an exposing step in which the photosensitive material is irradiated with light in accordance with image information, and a developing step in which the photosensitive material is developed after exposure.

Besides use in a printing system with an ordinary negative printer, the photosensitive material of the present invention is suitable for use in a scanning exposure system using cathode rays (CRT). In comparison with a device using a laser, a cathode-ray tube exposing device is simpler, more compact, and less expensive. Further, control of optical axis and color is easier with a cathode-ray tube exposing device. The cathode-ray tube for image exposure uses various luminescent materials which emit light in the desired spectral region. For example, any one of a red, green, and blue luminescent material is used, or alternatively, two or more of these luminescent materials are used in combination. The spectral regions are not limited to red, green, and blue. Also, a fluorescent substance which emits light in a yellow, orange, purple, or infrared region can also be used. In particular, a cathode-ray tube which emits white color by combined use of these luminescent materials is often used.

In the case where the photosensitive material has plural photosensitive layers each having a different spectral sensitivity distribution and the cathode tube has fluorescent substances emitting light in plural spectral regions, exposure to plural colors may be performed at the same time. In other words, image signals of plural colors may be inputted into the cathode-ray tube so that the lights of these colors are emitted from the tube face. Alternatively, a method in which the image signal of each color is successively inputted into the cathode-ray tube and exposure is carried out through films which each passes light of a single color but cuts other colors (i.e., a surface successive exposure) may be adopted. Generally, the surface successive exposure is preferable from the standpoint of improving the image qualities because a high-resolution cathode-ray tube can be used in this method.

For the photosensitive material of the present invention, a digital scanning exposure system which uses a single-color, high-density light such as a gas laser, light-emitting diode, semiconductor laser, or secondary high-frequency generating light source (SHG), formed of a combination of a semiconductor laser or a solid-state laser using a semiconductor laser as an exciting light source and a nonlinear optical crystal, is preferably used. In order to make the system compact and inexpensive, it is preferable to use a semiconductor laser or secondary high-frequency generating light source (SHG) formed of a combination of a semiconductor laser or solid-state laser and a nonlinear optical crystal. Particularly, in order to design a device, which is compact and inexpensive and has a long life and high stability, the use of a semiconductor laser is preferable and preferably at least one of light sources for exposure is a semiconductor laser.

Where such a scanning light source for exposure is used, the peak wavelength of spectral sensitivity of the photosensitive material of the present invention can be set as desired in accordance with the wavelength of the scanning light source to be used. In the SHG light source obtained by a combination of a solid-state laser using a semiconductor laser as an exciting light source or a semiconductor laser with a nonlinear optical crystal, the oscillation wavelength of the laser can be halved, and therefore blue light and green light can be obtained. Accordingly, the peaks of spectral sensitivity of the photosensitive material can be present in three ordinary blue, green, and red regions. If the exposure time is defined as the time required for exposing a pixel size corresponding to a pixel density of 400 dpi, the exposure time is preferably $10^{-4}$ second or less and more preferably $10^{-6}$ second or less.

The silver halide color photographic photosensitive material of the present invention can be preferably used in combination with exposure systems and developing systems described in the following conventionally known literature. Examples of the developing systems include the automatic printing system and developing system described in JP-A No. 10-333253, the equipment for transferring photosensitive materials described in JP-A No. 2000-10206, the recording system including an image-reading device described in JP-A No. 11-215312, the exposing system comprising a color-image recording method described in JP-A Nos. 11-88619 and 10-202950, the digital photoprint system including a remote diagnosis method described in JP-A No. 10-210206, and the photoprint system including the image-recording device described in Japanese Patent Application No. 10-159187.

Details of preferred scanning exposure systems that can be applied to the present invention are described in the patents listed in table 1 above.

When the photosensitive material of the present invention undergoes printer exposure, it is preferable to use a band-stop filter described in U.S. Pat. No. 4,880,726. The use of this filter eliminates color mixing due to light, and color reproductivity is remarkably increased.

In the present invention, copying regulation may be performed by subjecting the photosensitive material to pre-exposure using yellow microdot patterns before image information is supplied, as described in European Patent Nos. EP0,789,270A1 and EP0789480A1.

For processing of the photosensitive material of the present invention, the processing materials and processing methods which are described in JP-A No. 2-207250, lower right column, line 1, on page 26 to upper right column, line 9, on page 34 and in JP-A No. 4-97355, upper left column, line 17, on page 5 to lower right column, line 20, on page 18 can be preferably employed. As suitable preservatives used in developing solutions, the compounds shown in table 1 above are preferably used.

The present invention is also suitably used for a photosensitive material that has compatibility with rapid processing. When the rapid processing is carried out, the color developing time is preferably not more than 60 seconds, more preferably not more than 50 seconds and not less than 6 seconds, and most preferably not more than 30 seconds and not less than 6 seconds. Likewise, bleach-fixing time is preferably not more than 60 seconds, more preferably not more than 50 seconds and not less than 6 seconds, and most preferably not more than 30 seconds and not less than 6 seconds. Water-rinsing or stabilizing time is preferably not more than 150 seconds and more preferably not more than 130 seconds and not less than 6 seconds.

The color developing time means the time period from submergence of the photosensitive material into a color-developing solution to entrance of the photosensitive material into a bleach-fixing solution of a subsequent step. For example, if the photosensitive material is processed by an automatic developing machine, the color developing time means the sum of the time period during which the photosensitive material is immersed in the color-developing solution (known as "in-liquid time") and the time period during which the photosensitive material, after leaving the color-developing solution, travels in air to a bleach-fixing bath of the subsequent step (known as "in-air time"). Likewise, the bleach-fixing time means the time period from submergence of the photosensitive material into the bleach-fixing solution to entrance of the photosensitive material into the water-rinsing or stabilizing bath of a subsequent step. The water-rinsing or stabilizing time means the time period during which the photosensitive material stays in a water-rinsing or stabilizing solution and moves to a drying step after submergence of the photosensitive material into the liquid (known as "in-liquid time").

As to methods for developing the photosensitive material of the present invention after exposure thereof, a heat development system not using a processing liquid can be employed, as well as conventional wet-processes such as a method which uses a developing solution containing an alkali agent and a developing agent and a method in which a developing agent is incorporated in the photosensitive material so that development is carried out by using an activator liquid such as an alkaline solution containing no developing agent. In particular, the activator system is a preferred method because the processing solution does not contain a developing agent and control and handling of the processing solution are easy, and because the burden of waste water treatment is mitigated and advantages in terms of environmental protection are gained.

In the activator system, a hydrazine-type compound described in, for example, JP-A Nos. 8-234388, 9-152686, 9-152693, 9-211814, and 9-160193, is preferable as the developing agent or precursor thereof to be incorporated in the photosensitive material.

Also preferably used is a development method in which a coating amount of silver of the photosensitive material is reduced and image amplification (intensification) is carried out using hydrogen peroxide. In particular, use of this method in the activator system is preferable. More specifically, image-forming methods which use an activator solution containing hydrogen peroxide as described in JP-A Nos. 8-297354 and 9-152695 are preferably employed. In the activator system, the photosensitive material, after being treated with the activator solution, normally undergoes a desilvering treatment. However, with an image amplification treatment using a photosensitive material having a low silver content, the desilvering treatment can be omitted and a simple treatment such as rinsing with water or stabilization can be carried out. In a method in which image information is read by a scanner or the like from the photosensitive material, a processing mode that does not require a desilvering treatment can be employed even when a photosensitive material such as a photographic photosensitive material having a high silver content or the like is used.

The processing materials for the activator solution, desilvering solution (bleach/fixing solution), and water-rinsing and stabilizing solution, as well as processing methods, for use in the present invention may be conventionally known ones. Preferably, those described in Research Disclosure Item 36544 (September, 1994), pages 536-541, and JP-A No. 8-234388 can be used.

EXAMPLES

The following Examples illustrate the present invention. They are not to be construed as limitintg the present invention.

Example 1

(Preparation of Emulsion A to be Used in Blue-Sensitive Silver Halide Emulsion Layer)

A 1:1 (in silver molar ratio) mixture of an emulsion A1 made up of cubic large-size grains having an average grain size of 0.70 μm and an emulsion A2 made up of cubic small-size grains having an average grain size of 0.50 μm was prepared, and this mixture was designated as emulsion A. The variation coefficients of grain size distribution of the emulsion A1 and the emulsion A2 were 0.09 and 0.11, respectively. The each grain size emulsion was made up of grains each composed of silver chloride as a base and having 0.5 mol % of silver bromide localized in portions of the grain surface. In a portion ranging from an uppermost layer to a depth equivalent to 10% by volume of the grain, iodine ions in an amount of 0.1 mol % based on total halogen content, $K_4Ru(CN)_6$ in an amount of $1\times10^{-6}$ mol per mol of silver halide, yellow prussiate in an amount of $1\times10^{-7}$ mol per mol of silver halide, and $K_2IrCl_5(H_2O)$ in an amount of $1\times10^{-5}$ mol per mol of silver halide were incorporated.

Spectral sensitization of the emulsion A was carried out by adding the following blue-sensitive sensitizing dyes A and B in respective amounts of $3.2\times10^{-4}$ mol per mol of silver halide based on the emulsion A1 and adding the following blue-sensitive sensitizing dyes A and B in respective amounts of $4.4\times10^{-4}$ mol per mol of silver halide based on the emulsion A2.

(Sensitizing dye A)

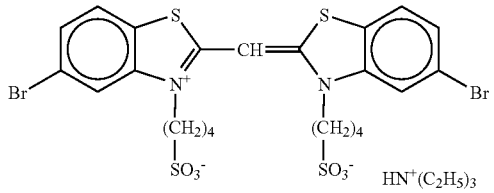

(Sensitizing dye B)

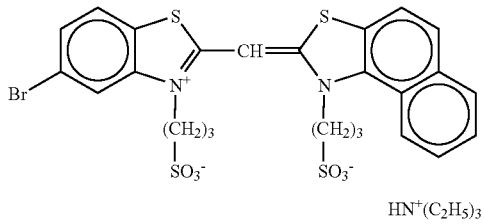

(Preparation of Emulsion B to be Used in Green-Sensitive Silver Halide Emulsion Layer)

An emulsion B made up of cubic grains having an average grain size of 0.40 μm was prepared. The variation coefficient of grain size distribution was of 0.09. The emulsion was prepared such that 0.1 mol % of silver iodide was incorporated into sites near to the grain surface and 0.4 mol % of silver bromide was localized at the grain surface. In the same way as in the case of the emulsion A, $K_4Ru(CN)_6$, yellow prussiate, and $K_2IrCl_5(H_2O)$ were incorporated into the grains of the emulsion. Next, the following sensitizing dye D, in an amount of $3.3\times10^{-4}$ mol per mol of silver halide, the following sensitizing dye E, in an amount of $5\times10^{-5}$ mol per mol of silver halide, and the following sensitizing dye F, in an amount of $2.3\times10^{-4}$ mol per mol of silver halide, were added.

(Sensitizing dye D)

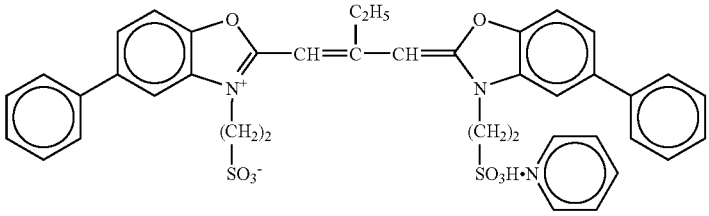

-continued (Sensitizing dye E)

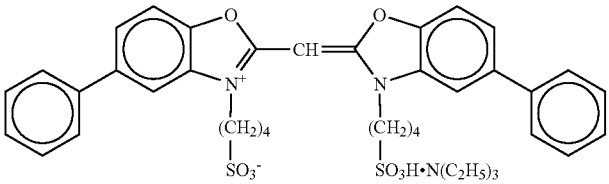

(Sensitizing dye F)

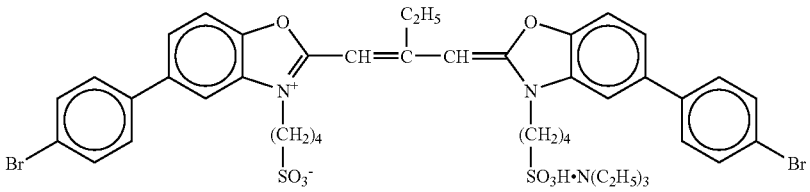

(Preparation of Emulsion C to be Used in Red-Sensitive Silver Halide Emulsion Layer)

A 1:1 (in silver molar ratio) mixture of an emulsion C1 made up of cubic large-size grains having an average grain size of 0.40 μm and an emulsion C2 made up of small-size grains having an average grain size of 0.30 μm was prepared. The variation coefficients of grain size distribution of the emulsion C1 and the emulsion C2 were 0.09 and 0.11, respectively. The emulsion of each grain size was prepared such that 0.1 mol % of silver iodide was incorporated into sites near to the grain surface and 0.8 mol % of silver bromide was localized at the grain surface. In the same way as in the case of the emulsion A, $K_4Ru(CN)_6$, yellow prussiate, and $K_2IrCl_5(H_2O)$ were incorporated into the grains of the emulsion. Next, the following sensitizing dyes G and H in respective amounts of $8.0\times10^{-5}$ mol per mol of silver halide based on the large-size emulsion were added, and the following sensitizing dyes G and H in respective amounts of $10.7\times10^{-5}$ mol per mol of silver halide based on the small-size emulsion were added. Further, the following compound I in an amount of $3.0\times10^{-3}$ mol per mol of silver halide of the red-sensitive silver halide emulsion layer was added.

(Sensitizing dye G)

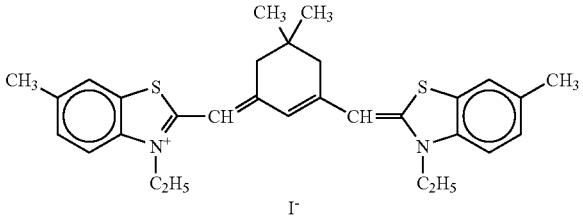

(Sensitizing dye H)

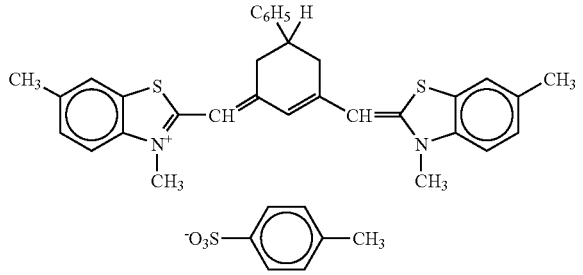

-continued (Compound I)

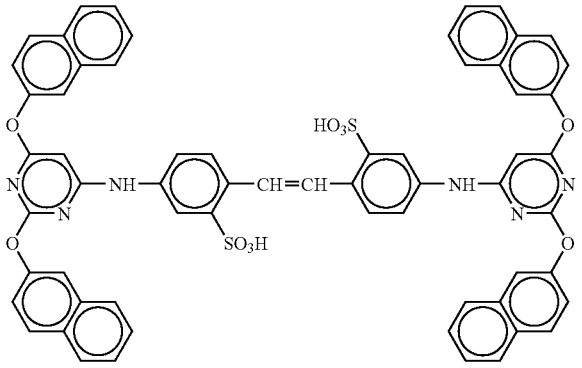

(Manufacture of Color Photographic Photosensitive Material, Coated Sample)

A support was a sheet of paper whose both sides were covered with a polyethylene resin. The support surface underwent a corona discharge treatment and thereafter was provided with a gelatin sublayer containing sodium dodecylbenzenesulfonate. After that, photographic constituent layers 1 to 7 were successively coated on the sublayer to produce Sample No. 101 of a silver halide color photographic photosensitive material having the following layer construction. Coating liquids for the respective photographic constituent layers were prepared in the following ways.

Preparation of Coating Liquid for Forming 1st Layer 57 g of a yellow coupler (ExY), 7 g of a color image stabilizer (Cpd-1), 4 g of a color image stabilizer (Cpd-2), 7 g of a color image stabilizer (Cpd-3), and 2 g of a color image stabilizer (Cpd-8) were dissolved in 21 g of a solvent (Solv-1) and 80 mL of ethyl acetate. The resulting solution was emulsified in 220 g of a 23.5% by mass gelatin aqueous solution containing 4 g of sodium dodecylbenzenesulfonate by means of a high-speed stirring machine for emulsification (a dissolver). After that, water was added to the product to make 900 g of an emulsified dispersion A.

The emulsified dispersion A and the emulsion A were mixed together to prepare a coating liquid for forming the 1st layer of the composition described later. Coating weight of the emulsion indicates a weight equivalent to weight of silver.

Coating liquids for forming the 2nd to 7th layers were prepared according to a method similar to that of the coating liquid for forming the 1st layer. The following (H-1) (i.e., sodium (2,4-dichloro-6-oxido-1,3,5-triazine), (H-2), and (H-3), in a total amount of 100 mg/m$^2$, were used as gelatin hardener for each layer. Further, the following Ab-1, Ab-2, Ab-3, and Ab-4, in amounts of 15.0 mg/m$^2$, 60.0 mg/m$^2$, 5.0 mg/m$^2$, and 10.0 mg/m$^2$, respectively, were added to each layer.

(H-1)

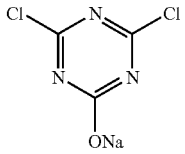

Hardener
(used at 1.4% by mass of the gelatin)

(H-2)

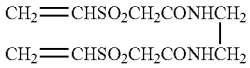

Hardener (H-3)

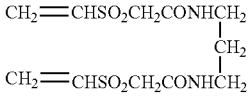

Hardener (Ab-1) Preservative

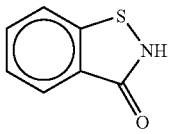

(Ab-2) Preservative

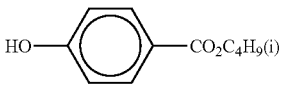

(Ab-3) Preservative

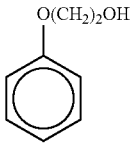

(Ab-4) Preservative

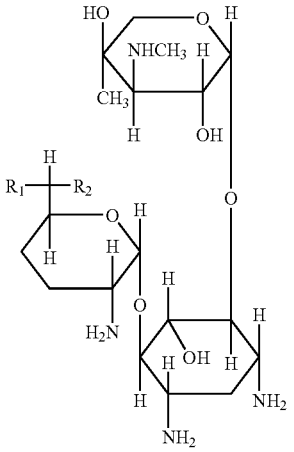

1:1:1:1 (by molar ratio) mixture of a, b, c, and d

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Next, the chemical sensitization process is explained. The emulsions described above were heated to 40° C. and optimum amounts of sodium thiosulfate pentahydrate and chloroauric acid were added. Subsequently, the emulsions were heated at 60° C. for 40 minutes, followed by the addition of the sensitizing dyes described above. Next, after the emulsions were cooled to 40° C., 1-(3-methylureidophenyl)-5-mercaptotetrazole was added to the blue-, green-, and red-sensitive emulsions in amounts of $3.3\times10^{-4}$ mol, $1.0\times10^{-3}$ mol, and $5.9\times10^{-4}$ mol per mol of silver halide, respectively.

Also, 1-(3-methylureidophenyl)-5-merocaptotetrazole was added to the 2nd, 4th, 6th, and 7th layers in amounts of 0.2 mg/m$^2$, 0.2 mg/m$^2$, 0.6 mg/m$^2$, and 0.1 mg/m$^2$, respectively.

Furthermore, to the blue-sensitive silver halide emulsion layer and the green-sensitive silver halide emulsion layer was added 4-hydroxy-6-methyl-1,3,3a,7-tetrazaindene, in amounts of $1\times10^{-4}$ mol per mol of silver halide and $2\times10^{-4}$ mol per mol of silver halide, respectively.

A latex of methacrylic acid/butyl acrylate copolymer (based on a monomer ratio by mass of 1:1 and having an average molecular weight of 200,000 to 400,000) in an amount equivalent to 0.05 mg/m$^2$ was added to the red-sensitive silver halide emulsion layer.

Disodium catechol-3,5-disulfonate was added to the 2nd, 4th, and 6th layers in amounts of 6 mg/m$^2$, 6 mg/m$^2$, and 18 mg/m$^2$, respectively.

Also, in order to prevent irradiation, the following dyes were added (numerals in parenthese indicate coating weights).

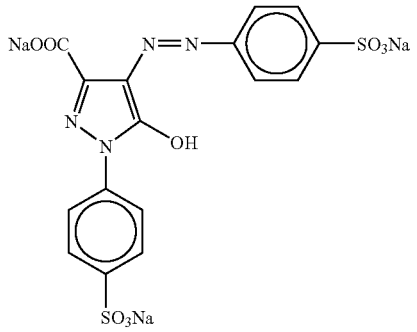

(2 mg/m$^2$)

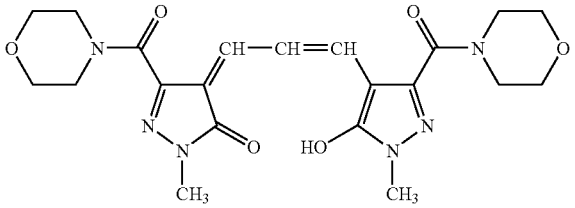

(2 mg/m$^2$)

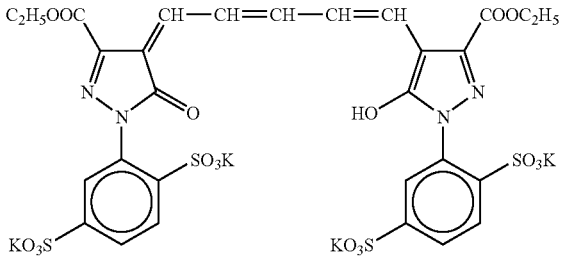

(3 mg/m$^2$)

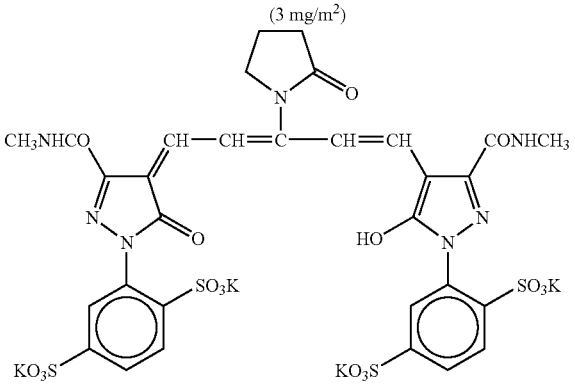

(7 mg/m$^2$)

(Layer Construction)

The composition of each layer of Sample 101 is given below. Each numeral indicates a coating weight (g/m$^2$). The amount of silver halide emulsion indicates the coating weight equivalent to weight of silver.

Support:

Paper laminated with polyethylene resin

[the polyethylene resin on the 1st layer side contains white pigments ($TiO_2$ content: 16% by mass, ZnO content: 4% by mass), a fluorescent brightener (4,4'-bis(5-methylbenzoxazolyl)stilbene, content: 0.03% by mass), and a bluing dye (ultramarine blue)]

| | |
|---|---|
| 1st layer (blue-sensitive silver halide emulsion layer) | |
| Emulsion A | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| 2nd layer (color mixing preventive layer) | |
| Gelatin | 0.99 |
| Color mixing preventive agent (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| 3rd layer (green-sensitive silver halide emulsion layer) | |
| Emulsion B | 0.14 |
| Gelatin | 1.36 |
| Magenta coupler (ExM) | 0.15 |
| Ultraviolet absorbing agent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| 4th layer (color mixing preventive layer) | |
| Gelatin | 0.71 |
| Color mixing preventive agent (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| 5th layer (red-sensitive silver halide emulsion layer) | |
| Emulsion C | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| 6th layer (ultraviolet absorbing layer) | |
| Gelatin | 0.46 |
| Ultraviolet absorbing agent (UV-B) | 0.45 |
| Compound (S1-4) | 0.0015 |
| Solvent (Solv-7) | 0.25 |
| 7th layer (protective layer) | |
| Gelatin | 1.00 |
| Acryl-modified copolymer of polyvinyl alcohol (degree of modification: 17%) | 0.04 |

-continued
| | |
|---|---|
| Liquid paraffin | 0.02 |
| Surfactant (Cpd-13) | 0.01 |
(ExY) Yellow coupler
A 70:30 (molar ratio) mixture of
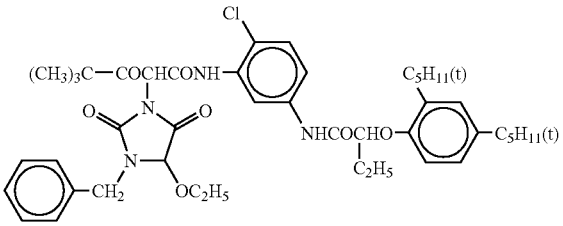
and
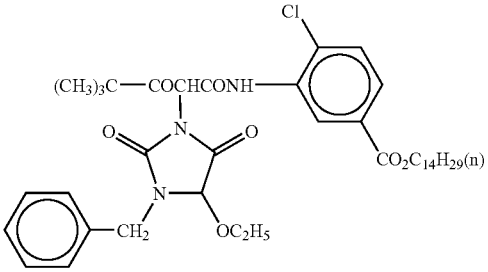
(ExM) Magenta coupler
A 40:40:20 (molar ratio) mixture of
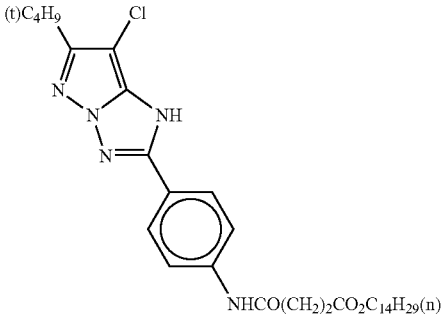
and
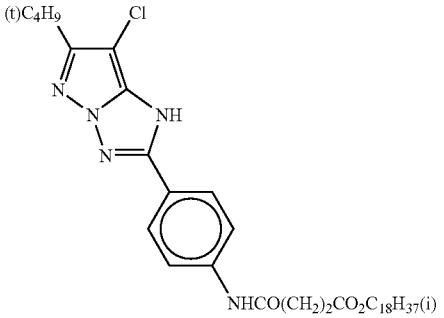
and
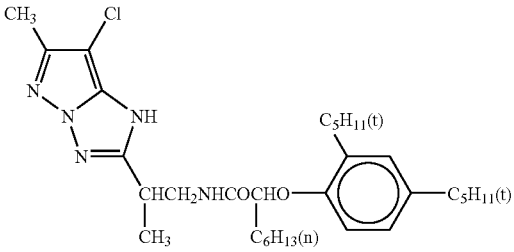
-continued
(ExC-2) Cyan coupler
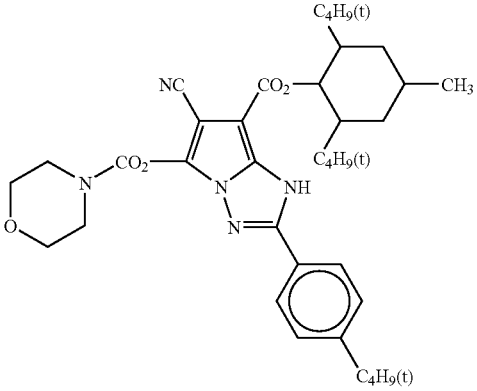
(ExC-3) Cyan coupler
A 50:25:25 (molar ratio) mixture of
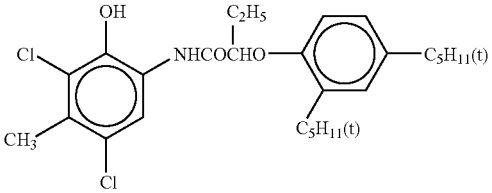
and
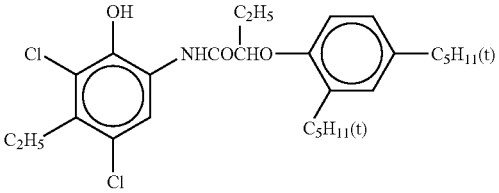
and
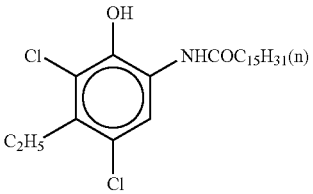
(Cpd-1) Color image stabilizer
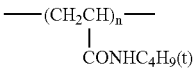
number average molecular weight 60,000
(Cpd-2) Color image stabilizer
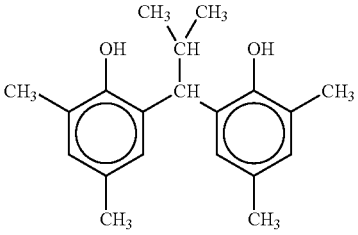

-continued (Cpd-3) Color image stabilizer

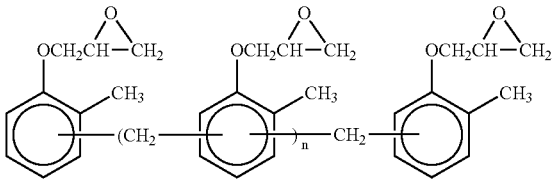

n = 7 to 8 (average)

(Cpd-4) Color mixing preventive agent

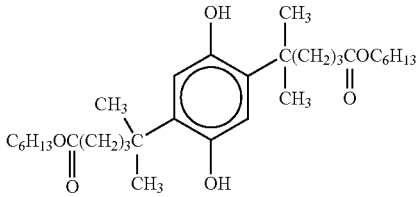

(Cpd-5) Color image stabilizer

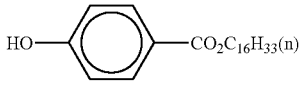

(Cpd-6) Color image stabilizer

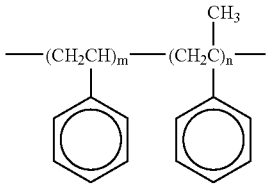

number average molecular weight: 600 m/n = 10/90

(Cpd-7) Color image stabilizer

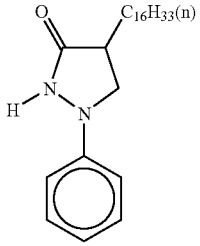

(Cpd-8) Color image stabilizer

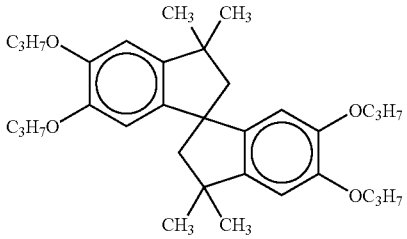

(Cpd-9) Color image stabilizer

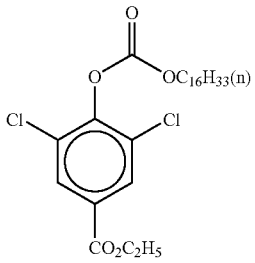

-continued (Cpd-10) Color image stabilizer

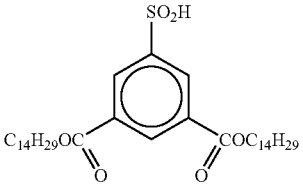

(Cpd-11)

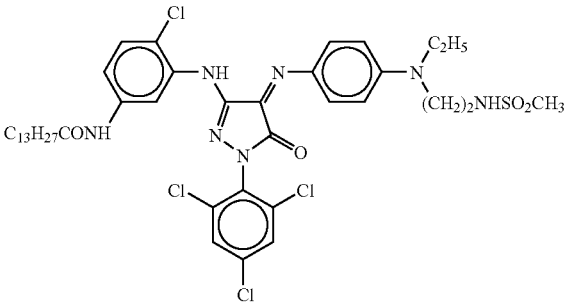

(Cpd-13) Surfactant

A 7:3 (molar ratio) mixture of

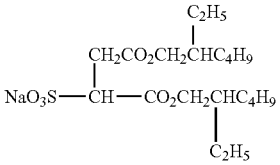

and

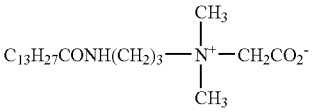

(Cpd-14)

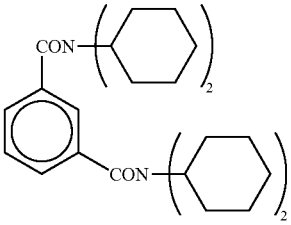

(Cpd-15)

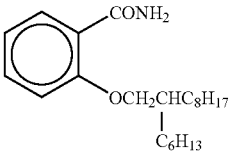

(Cpd-16)

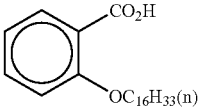

(Cpd-17)

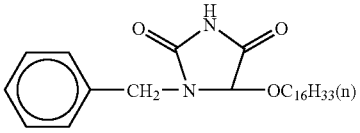

-continued (Cpd-18)

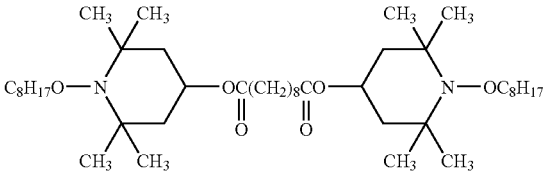

(Cpd-19) Color mixing preventive agent

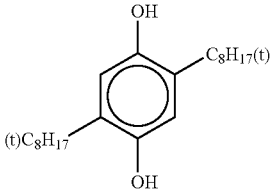

(UV-1) Ultraviolet absorbing agent

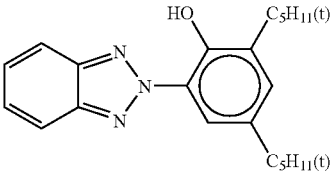

(UV-2) Ultraviolet absorbing agent

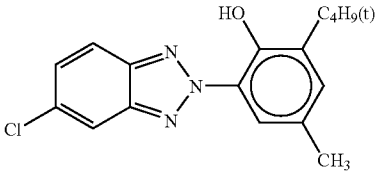

(UV-3) Ultraviolet absorbing agent

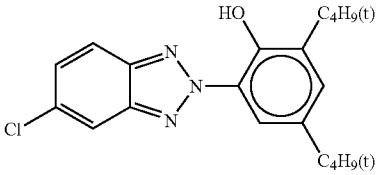

(UV-4) Ultraviolet absorbing agent

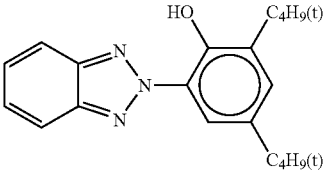

(UV-5) Ultraviolet absorbing agent

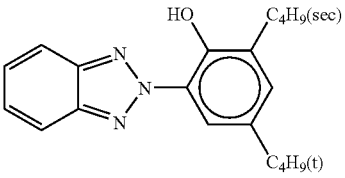

(UV-6) Ultraviolet absorbing agent

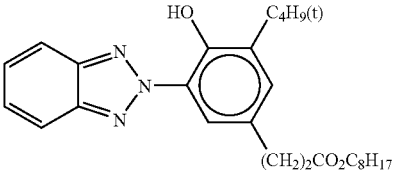

-continued (UV-7) Ultraviolet absorbing agent

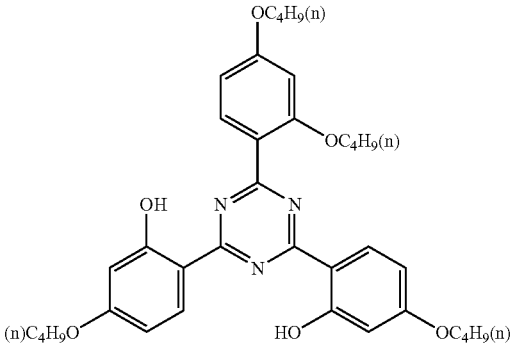

UV-A: 4/2/2/3 (mass ratio) mixture of UV-1, UV-2, UV-3, and UV-4
UV-B: 9/3/3/4/5/3 (mass ratio) mixture of UV-1, UV-2, UV-3, UV-4, UV-5 and UV-6
UV-C: 1/1/1/2 (mass ratio) mixture of UV-2, UV-3, UV-6 and UV-7

(Solv-1)

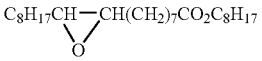

(Solv-2)

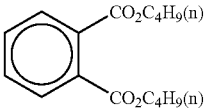

(Solv-3)

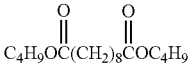

(Solv-4)

(Solv-5)

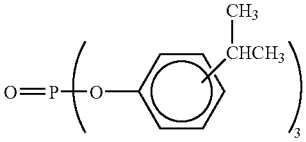

(Solv-7)

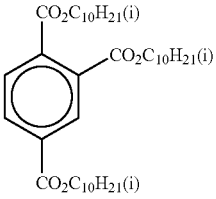

(Solv-8)

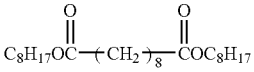

(S1-4)

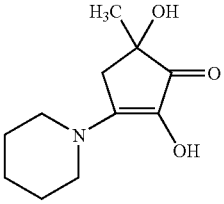

Samples 102 to 116 were manufactured in the same way as Sample 101, except that emulsions D to R containing the compounds shown in the following Table 2, respectively, were used in place of the emulsion B in the chemical sensitizing process. The emulsions D, E, and F included the comparative compound A which is described in JP-A No. 4-267249 as a gold sensitizer in place of chloroauric acid. The comparative compound A was added to the emulsions D and F immediately after preparation thereof as a 0.05% aqueous solution. A sample of the comparative compound A which had been stored for 4 weeks at 30° C. was added to the emulsion E after preparation thereof as a 0.05% aqueous solution. Likewise, the mesoionic compound was added to the emulsions I and K immediately after preparation thereof as an aqueous solution. A sample of the mesoionic compound which had been stored for 4 weeks at 30° C. was added to the emulsions J and L after preparation thereof as an aqueous solution. The aqueous solution a, which was obtained by mixing chloroauric acid and I-1, was added to the emulsion Q. The mixing method was the same as in the preparation of the reaction solution A described herein. Accordingly, the exemplary compound II-1 and bis(1,4,5-trimethyl-1,2,4-triazolium-3-thiolato)gold(I) tetrafluoroborate were present in the aqueous solution a.

In order to examine the photographic properties of these samples, the following experiments were conducted.

Experiment 1 Sensitometry (Low Illumination Intensity and High Illumination Intensity)

The coated samples were each subjected to gradation exposure for sensitometry using a sensitometer (manufactured by Fuji Photo Film Co., Ltd.: model FWH). The sensitometer was equipped with an SP-2 filter and the exposure was a low illumination intensity exposure of 10 seconds at 200 lux·second.

After that, magenta-developed color density of each of the samples was measured. In this way, the sensitivity at 10 seconds exposure to low illumination intensity and the sensitivity at $10^{-4}$ seconds exposure to high illumination intensity of the emulsions B and D to R were each obtained. The sensitivity was defined as the reciprocal of an exposure amount that gave a developed color density of 1.5 higher than the minimum developed color density and expressed as a relative value taking the sensitivity of Sample 101 after being processed as 100. The gradation was obtained from the slope of a straight line connecting sensitivity point of sample 101 and sensitivity point of density 1.5.

Experiment 2 Dependence of Sensitivity on Humidity at Exposure

The value of relative humidity when the samples were exposed was set to 55% and 80%. After the above-described exposure for 10 seconds, the samples were subjected to the processing A and the magenta-developed color density of each of the samples was measured. The sensitivity was defined as the reciprocal of an exposure amount that gave a developed color density of 0.5 higher than the minimum developed color density, and the sensitivity was expressed as a relative value taking the sensitivity of Sample 101 after being processed as 100. Next, a difference (hereinafter denoted dS) was obtained by subtracting the relative sensitivity for exposure at a humidity of 80% from the relative sensitivity for exposure at a humidity of 55%.

The results of Experiment 1 and Experiment 2 were collected and shown in the following Table 2.

TABLE 2

| Sample No. | Emulsion | Silver chloride content (mol %) | Gold sensitizer (17 μmol/mol · Ag) | Mesoionic compound (μmol/mol · Ag) | Sensitivity (10 seconds) | Sensitivity ($10^{-4}$ seconds) | dS (sensitivity difference due to RH) | Remarks |
|---|---|---|---|---|---|---|---|---|
| 101 | B | 99.5 | Chloroauric acid | None | 100 | 100 | 12 | Comparative Example |
| 102 | D | 99.5 | Comparative compound A | None | 108 | 112 | 10 | Comparative Example |
| 103 | E | 99.5 | Comparative compound A | None | 104 | 105 | 11 | Comparative Example |
| 104 | F | 99.5 | Comparative compound A | I-1 | 108 | 112 | 10 | Comparative Example |
| 105 | G | 99.5 | Comparative compound B | None | 107 | 110 | 10 | Comparative Example |
| 106 | H | 99.5 | Chloroauric acid | I-1 (34) | 114 | 118 | 6 | Present invention |
| 107 | I | 99.5 | Chloroauric acid | I-3 (34) | 115 | 119 | 6 | Present invention |
| 108 | J | 99.5 | Chloroauric acid | I-3 (34) | 115 | 119 | 6 | Present invention |
| 109 | K | 99.5 | Chloroauric acid | I-5 (34) | 115 | 119 | 5 | Present invention |
| 110 | L | 99.5 | Chloroauric acid | I-5 (34) | 115 | 119 | 5 | Present invention |
| 111 | M | 99.5 | Chloroauric acid | I-6 (34) | 115 | 119 | 5 | Present invention |
| 112 | N | 99.5 | Chloroauric acid | I-7 (34) | 116 | 120 | 5 | Present invention |
| 113 | O | 99.5 | Chloroauric acid | I-21 (34) | 114 | 118 | 6 | Present invention |
| 114 | P | 99.5 | Chloroauric acid | I-1 (68) | 115 | 119 | 5 | Present invention |
| 115 | Q | 99.5 | Chloroauric acid | I-1 (68) | 115 | 119 | 3 | Present invention |
| 116 | R | 99.5 | Chloroauric acid | II-1 (34) | 115 | 119 | 4 | Present invention |

Comparative compound A: bis(1,4,5-trimethyl-1,2,4-triazolium-3-thiolato)gold(I) tetrafluoroborate (described in JP-A No. 4-267249)
Comparative compound B: bis(4-(n)butyl-1,5-dimethyl-1,2,4-triazolium-3-thiolato)gold(I) tetrafluoroborate (described in JP-A No. 4-267249)

Also, the coated samples were each subjected to gradation exposure for sensitometry using a sensitometer for high illumination intensity exposure (manufactured by Yamashita Denso Co., Ltd.: model HIE). The sensitometer was equipped with an SP-2 filter and the samples were exposed to the high illumination intensities for $10^{-4}$ seconds.

After the exposure, the samples were subjected to color developing process A described later.

The following can be seen from the results shown in Table 2.

(1) In comparison with Sample 101 using chloroauric acid alone as a gold sensitizer, Samples 106 to 116, which are Examples of the present invention, exhibit higher sensitivity to low illumination intensity exposure and also exhibit higher sensitivity to high illumination intensity exposure. Sample 101 exhibits the problem that the sensitivity when exposure is made at high humidity is lower than the sensitivity when exposure is made at medium humidity. But this problem is mitigated remarkably in Samples 106 to 116 which are examples of the present invention.

(2) The photosensitive materials (Samples 102 and 105), which utilize the gold(I) compounds containing conventionally known mesoionic ligands (comparative compounds A and B), exhibit higher sensitivity in comparison with Sample 101, but the Examples of the present invention (Samples 106 to 116), which utilize chloroauric acid and mesoionic compounds, exhibit higher sensitivity and marked toughness with respect to changes in exposure humidity.

(3) Based on the results of Sample 104, it can be seen that an effect equivalent to that of the present invention cannot be obtained even if the mesoionic compound is added to the comparative compound A.

(4) Comparison between Sample 102 and Sample 103 indicates that use of the comparative compound A leads to low stability during manufacture. The sample, which was manufactured in the same way as the others using the comparative compound A, also leads to insufficient photographic reproductivity (since brown precipitate was observed in the 0.05% aqueous solution of the comparative compound A, this problem presumably originated from the solution stability problem of the comparative compound A). Meanwhile, Samples 107 and 108 (and Samples 109 and 110), which are Examples of the present invention and were manufactured in the same way, exhibit no difference in photographic properties. Accordingly, the use of a mesoionic compound and chloroauric compound makes it possible to increase stability in manufacture and alleviate problems with photographic reproductivity.

(5) Based on the results of Sample 116, it can be seen that use of the mesoionic oxidized form brings about the effects of the present invention.

(6) Based on the results of Sample 115, it can be seen that the method of manufacture, which includes mixing in advance a mesoionic compound and chloroauric acid to generate a mesoionic oxidized form and adding the mixture to the emulsion, brings about the effects of the present invention.

Processing steps are indicated below.

[Processing A]

Each of the photosensitive materials was made into a roll with a width of 127 mm and subjected to image-wise exposure using a MINI-LABO PRINTER PROCESSOR PP1258AR, manufactured by Fuji Photo Film Co., Ltd. After that, continuous processing (running test) of the samples was carried out according to the following processing steps until a replenished amount of a replenisher solution to the color developing tank reached double the tank capacity. The processing using this running liquid was designated as processing A.

| Processing step | Temperature | Duration | Replenished amount* |
|---|---|---|---|
| Color development | 38.5° C. | 45 seconds | 45 mL |
| Bleach-fixing | 38.0° C. | 45 seconds | 35 mL |
| Rinsing (1) | 38.0° C. | 20 seconds | — |
| Rinsing (2) | 38.0° C. | 20 seconds | — |

-continued

| Processing step | Temperature | Duration | Replenished amount* |
|---|---|---|---|
| Rinsing (3)** | 38.0° C. | 20 seconds | — |
| Rinsing (4)** | 38.0° C. | 30 seconds | 121 mL |

*Replenished amount per 1 $m^2$ of photosensitive material

**The rinsing step (3) used a rinse cleaning system RC50D manufactured by Fuji Photo Film Co., Ltd. The rinsing liquid was drawn from the rinsing step (3) by a pump to a reverse osmosis film module (RC50D). Permeated water thus obtained was fed to the rinsing step (4) and condensed water was returned to the rinsing step (3). The pump pressure was adjusted so that the amount of permeated water from the reverse osmosis module was maintained at 50to 300 mL/minute, and the circulation was carried out for 10 hours per day at a controlled temperature. (In the rinsing, a counter-current flow from tank (1) to (4) was employed).

The compositions of the processing solutions were as follows.

| | Tank solution | Replenisher solution |
|---|---|---|
| Color developing solution | | |
| Water | 800 mL | 800 mL |
| Dimethylpolysiloxane-based surfactant (SILICONE KF351A, manufactured by Shin-Etsu Chemical Co., Ltd.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorescent brightener (HAKKOL FWA-SF, manufactured by Showa Kagaku Co., Ltd.) | 2.5 g | 5.0 g |
| Sodium sulfite | 0.1 g | 0.1 g |
| Disodium-N,N-bis(sulfonateethyl)hydroxylamine | 8.5 g | 11.1 g |
| N-ethyl-N-(β-methanesulfonamidoethyl)-3-methyl-4-amino-4-aminoaniline.3/2 sulfate.monohydrate | 5.0 g | 15.7 g |
| Potassium carbonate | 26.3 g | 26.3 g |
| Water to make | 1000 mL | 1000 mL |
| pH (25° C., controlled by potassium hydroxide and sulfuric acid) | 10.15 | 12.50 |
| Bleach-fixing solution | | |
| Water | 700 mL | 600 mL |
| Iron(III) ammonium ethylenediaminetetraacetate | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/L) | 107.0 mL | 214.0 mL |
| Ammonium sulfite | 16.0 g | 32.0 g |
| Ammonium bisulfite | 23.1 g | 46.2 g |
| Water to make | 1000 mL | 1000 mL |
| pH (25° C., controlled by acetic acid and ammonia) | 6.0 | 6.0 |
| Rinsing solution | | |
| Sodium chloroisocyanurate | 0.02 g | 0.02 g |
| Deionized water (conductivity: 5 μS/cm or less) | 1000 mL | 1000 mL |
| PH | 6.5 | 6.5 |

Example 2

A sample in which the layer construction was changed from that of (101) to the following layer construction so that the layer thickness would be reduced was manufactured using the emulsions prepared in Example 1. Further, Samples 202 to 216 were manufactured by replacing the emulsion B in a 3rd layer with the emulsions D to R, respectively, as prepared in Example 1. These samples underwent the Experiments 1 and 2 described in Example 1.

The layer construction is shown for Sample 201.

The results were the same as in Example 1. Therefore, the effects of the present invention were confirmed also for ultra-rapid processing using samples having reduced layer thickness.

Manufacture of Sample 201

| | |
|---|---|
| 1st layer (blue-sensitive emulsion layer) | |
| Emulsion A | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| 2nd layer (color mixing preventive layer) | |
| Gelatin | 0.60 |
| Color mixing preventive agent (Cpd-19) | 0.09 |
| Color image stabilizer (Cpd-5) | 0.007 |
| Color image stabilizer (Cpd-7) | 0.007 |
| Ultraviolet absorbing agent(UV-C) | 0.05 |
| Solvent (Solv-5) | 0.11 |
| 3rd layer (green-sensitive emulsion layer) | |
| Silver chlorobromide emulsion B (the same emulsion as in Sample 101) | 0.14 |
| Gelatin | 0.73 |
| Magenta coupler (ExM) | 0.15 |
| Ultraviolet absorbing agent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| 4th layer (color mixing preventive layer) | |
| Gelatin | 0.48 |
| Color mixing preventive agent (Cpd-4) | 0.07 |
| Color image stabilizer (Cpd-5) | 0.006 |
| Color image stabilizer (Cpd-7) | 0.006 |
| Ultraviolet absorbing agent (UV-C) | 0.04 |
| Solvent (Solv-5) | 0.09 |
| 5th layer (red-sensitive emulsion layer) | |
| Silver chlorobromide emulsion C (the same emulsion as in Sample 101) | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorbing agent (UV-7) | 0.02 |
| Solvent (Solv-5) | 0.09 |

-continued

| | |
|---|---|
| 6th layer (ultraviolet absorbing layer) | |
| Gelatin | 0.32 |
| Ultraviolet absorbing agent (UV-C) | 0.42 |
| Solvent (Solv-7) | 0.08 |
| 7th layer (protective layer) | |
| Gelatin | 0.70 |
| Acryl-modified copolymer of polyvinyl alcohol (degree of modification: 17%) | 0.04 |
| Liquid paraffin | 0.01 |
| Surfactant (Cpd-13) | 0.01 |
| Polydimethylsiloxane | 0.01 |
| Silicon dioxide | 0.003 |

Each of the samples manufactured above underwent exposure in the same way as in Experiments 1 and 2 of Example 1. After that, the samples were processed for color development according to the following processing B, which is ultra-rapid processing.

[Processing B]

The photosensitive materials described above were each formed into a rolled web having a width of 127 mm and subjected to image-wise exposure from an average density negative film using an experimental apparatus obtained by modifying a MINI-LABO PRINTER PROCESSOR PP350, manufactured by Fuji Photo Film Co., Ltd., so that the processing time and the processing temperature could be changed. After that, continuous processing (running test) of the samples was carried out according to the following processing steps until the replenished amount of the replenisher solution to the color developing tank reached 0.5 times the tank capacity. The processing using this running liquid was designated as processing B.

| Processing step | Temperature | Time | Replenished amount* |
|---|---|---|---|
| Color development | 45.0° C. | 15 seconds | 45 mL |
| Bleach-fixing | 40.0° C. | 15 seconds | 35 mL |
| Rinsing (1) | 40.0° C. | 8 seconds | — |
| Rinsing (2) | 40.0° C. | 8 seconds | — |
| Rinsing (3)** | 40.0° C. | 8 seconds | — |
| Rinsing (4)** | 38.0° C. | 8 seconds | 121 mL |
| Drying | 80° C. | 15 seconds | |

*replenished amount per 1 $m^2$ of the photosensitive material

**The rinsing step (3) used a rinse cleaning system RC50D manufactured by Fuji Photo Film Co., Ltd. The rinsing liquid was drawn from the rinsing step (3) by a pump to a reverse osmosis film module (RC50D). The permeated water thusobtained was fed to the rinsing step (4) and the condensed water was returned to the rinsing step (3). The pump pressure was adjusted so that the amount of permeated water from the reverse osmosis was maintained at 50 to 300 mL/minute and the circulation was carried out for 10 hours per day at a controlled temperature. In the rinsing, a counter-current flow from tank (1) to (4) was employed.

The compositions of the processing solutions were as follows.

| | Tank solution | Replenisher solution |
|---|---|---|
| Color developing solution | | |
| Water | 800 mL | 600 mL |
| Fluorescent brightener(FL-1) | 5.0 g | 8.5 g |
| Tri(isopropanol)amine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium-N,N-bis(sulfonateethyl)hydroxylamine | 8.5 g | 14.5 g |
| 4-Amino-3-methyl-N-ethyl-N-(β-methanesulfonamidoethyl)aniline.3/2 sulfate.monohydrate | 10.0 g | 22.0 g |
| Potassium carbonate | 26.3 g | 26.3 g |
| Water to make | 1000 mL | 1000 mL |
| PH (25° C., controlled by sulfuric acid and KOH) | 10.35 | 12.6 |
| Bleach-fixing solution | | |
| Water | 800 mL | 800 mL |
| Ammonium thiosulfate (750 g/mL) | 107 mL | 214 mL |
| Succinic acid | 29.5 g | 59.0 g |
| Iron(III) ammonium ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| PH (25° C., controlled by nitric acid and ammonia) | 6.00 | 6.00 |
| Rinsing solution | | |
| Sodium chloroisocyanurate | 0.02 g | 0.02 g |
| Deionized water (conductivity: 5 μS/cm or less) | 1000 mL | 1000 mL |
| PH (25° C.) | 6.5 | 6.5 |

FL-1

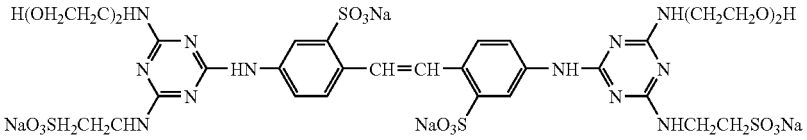

Example 3

By using Samples 201 to 216 manufactured in Example 2, images were formed by means of laser scanning exposure.

The laser light sources employed were: a 473 nm laser from SHG crystals of $LiNbO_3$ having an inverted domain structure which converted the wavelength of a YAG solid-state laser (oscillation wavelength: 946 nm) using a GaAlAs semiconductor laser (oscillation wavelength: 808.5 nm) as an excitation light source; a 532 nm laser from SHG crystals of $LiNbO_3$ having an inverted domain structure which converted the wavelength of a $YVO_4$ solid-state laser (oscillation wavelength: 1064 nm) using a GaAlAs semiconductor laser (oscillation wavelength: 808.7 nm) as an excitation light source; and a laser from AlGaInP (oscillation wavelength: about 680 nm, Type No. LN9R20 manufactured by Matsushita Electric Industrial Co., Ltd.). The three color lasers were each moved in a direction perpendicular to a scanning direction by means of a polygon mirror so that successive scanning exposures of the sample were possible. Light quantity variation due to temperatures of the semiconductor lasers was suppressed by keeping the temperature constant utilizing a Peltier element. The effective beam diameter was 80 μm, the scanning pitch was 42.3 μm (600 dpi), and the average exposure time per pixel was $1.7\times10^{-7}$ seconds.

After exposure, processing was carried out according to the color developing processing B. The results were the same as the results for high illumination intensity exposure in Examples 1 and 2. Therefore, it was found that these photosensitive materials were also suitable for image formation by use of laser scanning exposure.

Example 4

(Preparation of Emulsion 2A)

To 1000 mL of a 3% aqueous solution of lime-treated gelatin, whose pH and pCl had been adjusted to 3.3 and 1.7, respectively, were added an aqueous solution containing 2.12 moles of silver nitrate and an aqueous solution containing 2.2 moles of sodium chloride simultaneously with vigorous stirring at 68° C. After a desalting treatment at 40°

C. of the mixture, 168 g of lime-treated gelatin was added, pH was adjusted to 5.7, and pCl was adjusted to 1.8. An emulsion obtained in this way was an emulsion composed of cubic silver chloride grains having a grain side length of 0.6 μm and a variation coefficient of 11%.

(Preparation of Emulsion 2B)

An emulsion was prepared in the same way as in the preparation of the emulsion 2A, except that an aqueous solution of potassium iodide, in an amount equivalent to 0.3 mol % of iodine per mole of silver halide to be finally formed, was added with vigorous stirring at the time when the addition of silver nitrate was 90% complete. The emulsion obtained in this way was an emulsion composed of cubic silver chloroiodide grains having a grain side length of 0.6 μm and a variation coefficient of 11%.

(Preparation of Emulsion 2C)

An emulsion was prepared in the same way as in the preparation of the emulsion 2A, except that an aqueous solution of $K_2[IrCl_6]$ in an amount equivalent to $3\times10^{-8}$ moles of Ir per mole of silver halide to be finally formed was added over a period ranging from a time point of 70% addition of silver nitrate to a time point of 85% addition of silver nitrate. The emulsion obtained in this way was an emulsion composed of cubic silver chloride grains having a grain side length of 0.6 μm and a variation coefficient of 11%.

(Preparation of Emulsion 2D)

An emulsion was prepared in the same way as in the preparation of the emulsion 2A, except that an aqueous solution of $K_2[Ir(H_2O)Cl_5]$ in an amount equivalent to $1\times10^{-7}$ moles of Ir per mole of silver halide to be finally formed was added over a period ranging from a time point of 92% addition of silver nitrate to a time point of 98% addition of silver nitrate. The emulsion obtained in this way was an emulsion composed of cubic silver chloride grains having a grain side length of 0.6 μm and a variation coefficient of 11%.

(Preparation of Emulsion 2E)

An emulsion was prepared in the same way as in the preparation of the emulsion 2B, except that an aqueous solution of $K_2[IrCl_6]$ in an amount equivalent to $3\times10^{-8}$ moles of Ir per mole of silver halide to be finally formed was added over a period ranging from the time point of 70% addition of silver nitrate to the time point of 85% addition of silver nitrate. The emulsion obtained in this way was an emulsion composed of cubic silver chloroiodide grains having a grain side length of 0.6 μm and a variation coefficient of 11%.

(Preparation of Emulsion 2F)

An emulsion was prepared in the same way as in the preparation of the emulsion 2B, except that an aqueous solution of $K_2[Ir(H_2O)Cl_5]$ in an amount equivalent to $1\times10^{-7}$ moles of Ir per mole of silver halide to be finally formed was added over a period ranging from the time point of 92% addition of silver nitrate to the time point of 98% addition of silver nitrate. The emulsion obtained in this way was an emulsion composed of cubic silver chloroiodide grains having a grain side length of 0.6 μm and a variation coefficient of 11%.

(Preparation of Emulsion 2G)

An emulsion was prepared in the same way as in the preparation of the emulsion 2B, except that an aqueous solution of $K_2[IrCl_6]$ in an amount equivalent to $3\times10^{-8}$ moles of Ir per mole of silver halide to be finally formed was added over a period ranging from the time point of 70% addition of silver nitrate to the time point of 85% addition of silver nitrate; and, further, an aqueous solution of $K_2[Ir(H_2O)Cl_5]$ in an amount equivalent to $1\times10^{-7}$ moles of Ir per mole of silver halide to be finally formed was added over a period ranging from the time point of 92% addition of silver nitrate to the time point of 98% addition of silver nitrate. The emulsion obtained in this way was an emulsion composed of cubic silver chloroiodide grains having a grain side length of 0.6 μm and a variation coefficient of 11%.

(Preparation of Emulsion 2H)

An emulsion was prepared in the same way as in the preparation of the emulsion 2F, except that an aqueous solution of $K_4[Ru(CN)_6].3H_2O$ in an amount equivalent to $2\times10^{-5}$ moles of Ru per mole of silver halide to be finally formed was added over a period ranging from the time point of 70% addition of silver nitrate to the time point of 85% addition of silver nitrate. The emulsion obtained in this way was an emulsion composed of cubic silver chloroiodide grains having a grain side length of 0.6 μm and a variation coefficient of 11%.

(Preparation of Emulsion 2I)

An emulsion was prepared in the same way as in the preparation of the emulsion 2G, except that an aqueous solution of $K_4[Ru(CN)_6].3H_2O$ in an amount equivalent to $2\times10^{-5}$ moles of Ru per mole of silver halide to be finally formed was added over a period ranging from the time point of 70% addition of silver nitrate to the time point of 85% addition of silver nitrate. The emulsion obtained in this way was an emulsion composed of cubic silver chloroiodide grains having a grain side length of 0.6 μm and a variation coefficient of 11%.

The 9 kinds of emulsion prepared above underwent the following 3 chemical sensitizations, the emulsions 2A to 2G undergoing the chemical sensitization X or Y; the emulsion 2H undergoing the chemical sensitization Y alone; and the emulsion 2I undergoing the chemical sensitization Y or Z.

(Chemical Sensitization X)

To the emulsion, which had been heated to 40° C., were added sodium thiosulfonate in an amount of $2\times10^{-5}$ mol per mol of silver halide, sodium thiosulfate pentahydrate in an amount of $2\times10^{-6}$ mol per mol of silver halide, chloroauric acid as a gold sensitizer in an amount of $1.2\times10^{-5}$ mol per mol of silver halide, and potassium thiocyanate in an amount of $1.2\times10^{-4}$ mol per mol of silver halide. The emulsion was then ripened at 60° C. for 40 minutes. Next, after the emulsion had cooled to 40° C., the sensitizing dye J in an amount of $2\times10^{-4}$ mol per mol of silver halide, the sensitizing dye K in an amount of $1\times10^{-4}$ mol per mol of silver halide, 1-phenyl-5-mercaptotetrazole in an amount of $2\times10^{-4}$ mol per mol of silver halide, 1-(5-methylureidophenyl)-5-mercaptotetrazole in an amount of $2\times10^{-4}$ mol per mol of silver halide, and potassium bromide in an amount of $2\times10^{-3}$ mol per mol of silver halide were added.

Sensitizing dye J

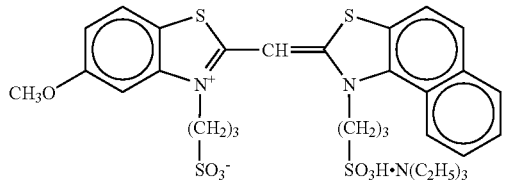

-continued

Sensitizing dye K

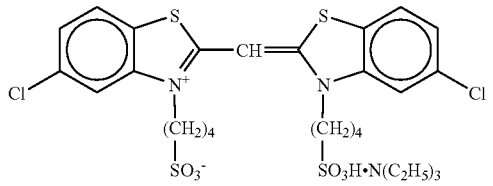

(Chemical Sensitization Y)

Chemical sensitization Y differed from Chemical sensitization X only in that (S-2) in an amount of $1.2\times10^{-5}$ mol per mol of silver halide was added as the gold sensitizer in place of the chloroauric acid.

(Chemical Sensitization Z)

Chemical sensitization Z differed from Chemical sensitization X only in that (S-3) in an amount of $1.4\times10^{-5}$ mol per mol of silver halide was added as the gold sensitizer in place of the chloroauric acid.

The support was a sheet of paper whose both sides were covered with a polyethylene resin. The support surface underwent a corona discharge treatment and thereafter was provided with a gelatin sublayer containing sodium dodecylbenzenesulfonate. After that, the photographic constituent layers 1 to 7 were coated successively on the sublayer. In this way, a silver halide color photographic photosensitive material having the following layer construction was manufactured. The coating liquids for the respective photographic constituent layers were prepared in the following manner.

Preparation of Coating Liquid for Forming the 1st Layer 57 g of a yellow coupler (ExY), 7 g of a color image stabilizer (Cpd-1), 4 g of a color image stabilizer (Cpd-2), 7 g of a color image stabilizer (Cpd-3), and 2 g of a color image stabilizer (Cpd-8) were dissolved in 21 g of a solvent (Solv-1) and 80 mL of ethyl acetate. The resulting solution was emulsified in 220 g of a 23.5% by mass gelatin aqueous solution containing 4 g of sodium dodecylbenzenesulfonate by means of a high-speed stirrer for emulsification (dissolver). After that, water was added to the product to make 900 g of an emulsified dispersion 2A.

The emulsified dispersion 2A and an emulsion which had been obtained by subjecting the emulsion 2A to the chemical sensitization Y, were mixed together so that a coating liquid for forming the 1st layer having the composition described later was prepared. Coating weight of the emulsion indicates a weight equivalent to weight of silver.

Coating liquids for forming the 2nd to 7th layers were prepared according to methods similar to that of the coating liquid for forming the 1st layer. (H-1) (a sodium salt of 1-oxy-3,5-dichloro-s-triazine), (H-2), and (H-3) in a total amount of 100 mg/m$^2$ were used as gelatin hardener for each layer. Further, Ab-1, Ab-2, Ab-3, and Ab-4, in amounts of 15.0 mg/m$^2$, 60.0 mg/m$^2$, 5.0 mg/m$^2$, and 10.0 mg/m$^2$, respectively, were added to each layer.

The above-mentioned sensitizing dyes D to H were used in silver chlorobromide emulsions in the green-sensitive and red-sensitive emulsion layers.

Green-Sensitive Emulsion Layer (The sensitizing dye D in an amount of $3.0\times10^{-4}$ mol per mol of silver halide was added to the large-size emulsion. The sensitizing dye D in an amount of $3.6\times10^{-4}$ mol per mol of silver halide was added to the small-size emulsion. The sensitizing dye E in an amount of $4.0\times10^{-5}$ mol per mol of silver halide was added to the large-size emulsion. The sensitizing dye E in an amount of $7.0\times10^{-5}$ mol per mol of silver halide was added to the small-size emulsion. The sensitizing dye F in an amount of $2.0\times10^{-4}$ mol per mol of silver halide was added to the large-size emulsion. The sensitizing dye F in an amount of $2.8\times10^{-4}$ mol per mol of silver halide was added to the small-size emulsion.)

Red-Sensitive Emulsion Layer (The sensitizing dye G in an amount of $8.0\times10^{-5}$ mol per mol of silver halide was added to the large-size emulsion. The sensitizing dye H in an amount of $8.0\times10^{-5}$ mol per mol of silver halide was added to the large-size emulsion. The sensitizing dye G in an amount of $10.7\times10^{-5}$ mol per mol of silver halide was added to the small-size emulsion. The sensitizing dye H in an amount of $10.7\times10^{-5}$ mol per mol of silver halide was added to the small-size emulsion. Further, the compound I in an amount of $3.0\times10^{-3}$ mol per mol of silver halide was added to the red-sensitive emulsion layer.)

Still further, 1-(3-methylureidophenyl)-5-mercaptotetrazole was added to the green-sensitive emulsion layer and the red-sensitive emulsion layer in amounts of $1.0\times10^{-3}$ mol and $5.9\times10^{-4}$ mol per mol of silver halide, respectively. Furthermore, 1-(3-methylureidophenyl)-5-mercaptotetrazole was added to the 2nd layer, the 4th layer, the 6th layer, and the 7th layer in amounts equivalent to 0.2 mg/m$^2$, 0.2 mg/m$^2$, 0.6 mg/m$^2$, and 0.1 mg/m$^2$, respectively.

4-hydroxy-6-methyl-1,3,3a,7-tetrazaindene was added to the blue-sensitive emulsion layer and green-sensitive emulsion layer in amounts of $1\times10^{-4}$ mol and $2\times10^{-4}$ mol per mol of silver halide, respectively. A latex of a methacrylic acid/butyl acrylate copolymer (based on a monomer ratio by mass of 1:1 and having an average molecular weight of 200,000 to 400,000) was added to the red-sensitive emulsion layer in an amount equivalent to 0.05 mg/m$^2$. Disodium catechol-3,5-disulfonate was added to the 2nd layer, the 4th layer, and the 6th layer in amounts equivalent to 6 mg/m$^2$, 6 mg/m$^2$, and 18 mg/m$^2$, respectively.

Furthermore, in order to prevent irradiation, the above-mentioned dyes (numerals in parentheses indicate coating amounts) were added.

(Layer Construction)

The composition of each layer is given below. Each numeral indicates a coating weight (g/m$^2$). The amount of the silver halide emulsion indicates a coating weight equivalent to weight of silver.

Support

Paper laminated with a polyethylene resin (polyethylene resin on the 1st layer side contains white pigments ($TiO_2$ content: 16% by mass; ZnO content: 4% by mass), a fluorescent brightener (4,4'-bis(5-methylbenzoxazolyl) stilbene, content 0.03% by mass), and a bluing dye (ultramarine blue).)

| | |
|---|---|
| 1st layer (blue-sensitive emulsion layer) | |
| Emulsion | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| 2nd layer (color mixing preventive layer) | |
| Gelatin | 0.99 |
| Color mixing preventive (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |

-continued

| | |
|---|---|
| 3rd layer (green-sensitive emulsion layer) | |
| Silver chlorobromide emulsion (a 1:3 (in silver molar ratio) mixture of a large-size emulsion having an average grain size of 0.45 μm and a small-size emulsion having an average grain size of 0.35 μm, each composed of cubic grains that had undergone gold-sulfur sensitization, having variation coefficients of grain size distribution of 0.10 and 0.08, respectively, and each containing 0.15 mol % of silver iodide near to the grain surface and 0.4 mol % of silver bromide localized in portions of the grain surface) | 0.14 |
| Gelatin | 1.36 |
| Magenta coupler (ExM) | 0.15 |
| Ultraviolet absorbing agent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| 4th layer (color mixing preventive layer) | |
| Gelatin | 0.71 |
| Color mixing preventive (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| 5th layer (red-sensitive emulsion layer) | |
| Silver chlorobromide emulsion (a 5:5 (in silver molar ratio) mixture of a large-size emulsion having an average grain size of 0.40 μm and a small-size emulsion having an average grain size of 0.30 μm, each composed of cubic grains that had undergone gold-sulfur sensitization, having variation coefficients of grain size distribution of 0.09 and 0.11, respectively, and each containing 0.1 mol % of silver iodide near to the grain surface and 0.8 mol % of silver bromide localized in portions of the grain surface) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |

-continued

| | |
|---|---|
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| 6th layer (ultraviolet absorbing layer) | |
| Gelatin | 0.46 |
| Ultraviolet absorbing agent (UV-B) | 0.45 |
| Compound (S1-4) | 0.0015 |
| Solvent (Solv-7) | 0.25 |
| 7th layer (protective layer) | |
| Gelatin | 1.00 |
| Acryl-modified copolymer of polyvinyl alcohol (degree of modification: 17%) | 0.04 |
| Liquid paraffin | 0.02 |
| Surfactant (Cpd-13) | 0.01 |

Further, samples were manufactured in the same way as in the production of the above-described sample, except that combinations of the emulsion and chemical sensitization in the blue-sensitive emulsion layer were changed as shown in the following Table 3.

In order to examine the photographic properties of the samples obtained above, the following experiments were conducted.

The coated samples were each subjected to gradation exposure for sensitometry using a sensitometer for high illumination intensity exposure (manufactured by Yamashita Denso Co., Ltd., model HIE). The sensitometer was equipped with an SP-1 filter manufactured by Fuji Photo Film Co., Ltd. and the samples were exposed to a high illumination intensity for $10^{-4}$ seconds. After the exposure, the samples were subjected to the color developing processing A described previously.

After that, yellow-developed color density of each of the samples was measured. Sensitivity was defined as the reciprocal of an exposure amount that gave a developed color density of 1.0 higher than the minimum developed color density, and expressed as a relative value by taking the sensitivity of the sample containing the emulsion 2A that had undergone the chemical sensitization X as 100. Further, the gradation was obtained from the slope of a straight line passing through this sensitivity point and a sensitivity point at a density of 1.5. The results are shown in the following Table 3.

TABLE 3

| Emulsion | Silver chloride content (mol %) | Silver iodide content (mol %) | Chemical sensitization | I | Ir | $Ru(CN)_6$ | Gold sensitizer* | Sensitivity | Gradation** | Remarks |
|---|---|---|---|---|---|---|---|---|---|---|
| 2A | 100 | — | X | No | No | No | $HAuCl_4$ | 100 | 1.5 | Comparative Example |
| 2A | 100 | — | Y | No | No | No | (S-2) | 107 | 1.6 | Comparative Example |
| 2B | 99.7 | 0.3 | X | Yes | No | No | $HAuCl_4$ | 186 | 1.2 | Comparative Example |
| 2B | 99.7 | 0.3 | Y | Yes | No | No | (S-2) | 195 | 1.2 | Comparative Example |
| 2C | 100 | — | X | No | $K_2IrCl_6$ | No | $HAuCl_4$ | 132 | 1.8 | Comparative Example |
| 2C | 100 | — | Y | No | $K_2IrCl_6$ | No | (S-2) | 138 | 1.9 | Comparative Example |
| 2D | 100 | — | X | No | $K_2Ir(H_2O)Cl_5$ | No | $HAuCl_4$ | 135 | 1.6 | Comparative Example |
| 2D | 100 | — | Y | No | $K_2Ir(H_2O)Cl_5$ | No | (S-2) | 141 | 1.7 | Comparative Example |
| 2E | 99.7 | 0.3 | X | Yes | $K_2IrCl_6$ | No | $HAuCl_4$ | 219 | 1.7 | Comparative Example |
| 2E | 99.7 | 0.3 | Y | Yes | $K_2IrCl_6$ | No | (S-2) | 240 | 2.1 | Example |
| 2F | 99.7 | 0.3 | X | Yes | $K_2Ir(H_2O)Cl_5$ | No | $HAuCl_4$ | 209 | 1.6 | Comparative Example |
| 2F | 99.7 | 0.3 | Y | Yes | $K_2Ir(H_2O)Cl_5$ | No | (S-2) | 229 | 2.2 | Example |
| 2G | 99.7 | 0.3 | X | Yes | $K_2IrCl_6 + K_2Ir(H_2O)Cl_5$ | No | $HAuCl_4$ | 195 | 1.8 | Comparative Example |
| 2G | 99.7 | 0.3 | Y | Yes | $K_2IrCl_6 + K_2Ir(H_2O)Cl_5$ | No | (S-2) | 219 | 2.5 | Example |

TABLE 3-continued

| Emulsion | Silver chloride content (mol %) | Silver iodide content (mol %) | Chemical sensi-tization | I | Ir | $Ru(CN)_6$ | Gold sensitizer* | Sensitivity | Gradation** | Remarks |
|---|---|---|---|---|---|---|---|---|---|---|
| 2H | 99.7 | 0.3 | Y | Yes | $K_2Ir(H_2O)Cl_5$ | Yes | (S-2) | 245 | 2.3 | Example |
| 2I | 99.7 | 0.3 | Y | Yes | $K_2IrCl_6 + K_2Ir(H_2O)Cl_5$ | Yes | (S-2) | 234 | 2.6 | Example |
| 2I | 99.7 | 0.3 | Z | Yes | $K_2IrCl_6 + K_2Ir(H_2O)Cl_5$ | Yes | (S-3) | 229 | 2.6 | Example |

*When $HAuCl_4$ was used as a gold sensitizer and the chemical sensitization X was employed, $HAuCl_4$ was Changed to a gold sensitizer having SCN coordination because potassium thiocyanate was added in the chemical sensitization X.
**The larger the value, the higher and more desirable the contrast obtained.

As is clear from the results of Table 3, although the incorporation of either an I or Ir compound into the silver chloride emulsion raises the sensitivity to high illumination intensity, the gradation was of a soft tone. Even when the gold sensitization of the present invention was applied to these emulsions, the rise in sensitivity and contrast was only slight. By contrast, the application of the gold sensitization of the present invention to an emulsion containing I and Ir brought about a remarkable rise in sensitivity and contrast.

Example 5

Samples in which the layer construction was changed to the following layer construction so that the thickness of the layer construction would be reduced were manufactured and subjected to the experiments of Example 4. The results were the same as for Example 4. Therefore, the effects of the present invention were confirmed also for ultra-rapid processing using samples having reduced layer thickness.

Production of Samples

| | |
|---|---|
| 1st layer (blue-sensitive emulsion layer) | |
| Emulsion | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| 2nd layer (color mixing preventive layer) | |
| Gelatin | 0.60 |
| Color mixing preventive agent (Cpd-19) | 0.09 |
| Color image stabilizer (Cpd-5) | 0.007 |
| Color image stabilizer (Cpd-7) | 0.007 |
| Ultraviolet absorbing agent(UV-C) | 0.05 |
| Solvent (Solv-5) | 0.11 |
| 3rd layer (green-sensitive emulsion layer) | |
| Silver chlorobromide emulsion (the same emulsion as in the sample of Example 4) | 0.14 |
| Gelatin | 0.73 |
| Magenta coupler (ExM) | 0.15 |
| Ultraviolet absorbing agent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |

-continued

| | |
|---|---|
| 4th layer (color mixing preventive layer) | |
| Gelatin | 0.48 |
| Color mixing preventive agent (Cpd-4) | 0.07 |
| Color image stabilizer (Cpd-5) | 0.006 |
| Color image stabilizer (Cpd-7) | 0.006 |
| Ultraviolet absorbing agent (UV-C) | 0.04 |
| Solvent (Solv-5) | 0.09 |
| 5th layer (red-sensitive emulsion layer) | |
| Silver chlorobromide emulsion (the same emulsion as in the sample of Example 4) | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorbing agent (UV-7) | 0.02 |
| Solvent (Solv-5) | 0.09 |
| 6th layer (ultraviolet absorbing layer) | |
| Gelatin | 0.32 |
| Ultraviolet absorbing agent (UV-C) | 0.42 |
| Solvent (Solv-7) | 0.08 |
| 7th layer (protective layer) | |
| Gelatin | 0.70 |
| Acryl-modified copolymer of polyvinyl alcohol (degree of modification: 17%) | 0.04 |
| Liquid paraffin | 0.01 |
| Surfactant (Cpd-13) | 0.01 |
| Polydimethylsiloxane | 0.01 |
| Silicon dioxide | 0.003 |

Each of the samples produced as above underwent exposure in the same way as in Example 4. After that, the samples were processed for color development according to the processing B, which was ultra-rapid processing.

Example 6

Using the samples of Example 5, images were formed by means of laser scanning exposure.

The laser light sources employed were: a 473 nm laser from SHG crystals of $LiNbO_3$ having an inverted domain structure which converted the wavelength of a YAG solid-state laser (oscillation wavelength: 946 nm) using a GaAlAs semiconductor laser (oscillation wavelength: 808.5 nm) as an excitation light source; a 532 nm laser from SHG crystals of $LiNbO_3$ having an inverted domain structure which converted the wavelength of a $YVO_4$ solid-state laser (oscillation wavelength: 1064 nm) using a GaAlAs semiconductor laser (oscillation wavelength: 808.7 nm) as an excitation light source; and a laser from AlGaInP (oscillation wavelength: about 680 nm, Type No. LN9R20 manufactured by Matsushita Electric Industrial Co., Ltd.). The three color lasers were each moved in a direction perpendicular to a scanning direction by means of a polygon mirror so that successive scanning exposures of the sample were possible. Light quantity variation due to temperatures of the semiconductor lasers was suppressed by keeping the temperature constant utilizing a Peltier element. The effective beam diameter was 80 μm, the scanning pitch was 42.3 μm (600 dpi), and the average exposure time per pixel was $1.7\times10^{-7}$ seconds. After exposure, processing was carried out according to the color developing processing B. The samples of the present invention exhibited high sensitivity and gradation similarly to the results for high illumination intensity exposure in Example 5. Therefore, it was found that these photosensitive materials were also suitable for image formation using laser scanning exposure.

What is claimed is:

1. A silver halide emulsion comprising an oxidatively dimerized form of a mesoionic compound having a thiolate structure, and silver chloride of at least 90 mol % by content, the oxidatively dimerized form of a mesoionic compound having a thiolate structure represented by the following formula:

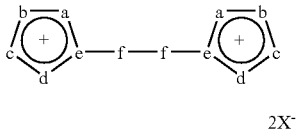

wherein in the formula, f represents a sulfur atom, e represents a carbon atom, and a, b, c, and d are each an unsubstituted or substituted atom constituting an aromatic 5-membered heterocycle having a positive charge and each independently represents a C—R group, an N—R' group, an oxygen atom, or a sulfur atom, where R and R' each independently represents a hydrogen atom or a substituent.

2. The silver halide emulsion according to claim 1, further comprising a gold sensitizer.

3. The silver halide emulsion comprising an oxidatively dimerized form of a mesoionic compound having a thiolate structure according to claim 1, wherein the oxidatively dimerized form of a mesoionic compound having a thiolate structure is obtained by mixing a mesoionic compound and an Au (III) compound in water, the mesoionic compound being represented by the following formula:

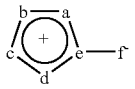

wherein, in the formula, f represents a sulfur atom, e represents a carbon atom, and a, b, c, and d are each an unsubstituted or substituted atom constituting a 5-membered ring of the mesoionic compound and each independently represents a C—R group, an N—R' group, an oxygen atom, or a sulfur atom, where R and R' each independently represents a hydrogen atom or a substituent.

4. A silver halide color photographic photosensitive material comprising a support, and, disposed on the support, at least one blue-sensitive silver halide emulsion layer, at least one green-sensitive silver halide emulsion layer, and at least one red-sensitive silver halide emulsion layer, wherein at least one of the blue-sensitive silver halide emulsion layer, the green-sensitive silver halide emulsion layer, and the red-sensitive silver halide emulsion layer comprises the silver halide emulsion according to claim 1.

5. An image-forming method comprising the steps of:

exposing the silver halide color photographic photosensitive material according to claim 4 on the basis of image information; and thereafter, developing the silver halide color photographic photosensitive material, wherein the exposing step comprises the step of scanning the silver halide color photographic photosensitive material with a laser beam modulated on the basis of the image information, with an exposure time per pixel of at most $10^{-4}$ seconds.

6. A method of preparing a composition for use in image formation, the method comprising the steps of:

(a) preparing a silver halide emulsion including silver chloride of at least 90 mol % by content;

(b) adding an oxidatively dimerized form of a mesoionic compound comprising a thiolate structure to the emulsion, the oxidatively dimerized form of a mesoionic compound having a thiolate structure represented by the following formula:

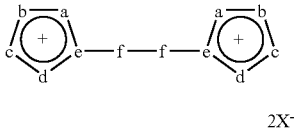

wherein in the formula, f represents a sulfur atom, e represents a carbon atom, and a, b, c, and d are each an unsubstituted or substituted atom constituting an aromatic 5-membered heterocycle having a positive charge and each independently represents a C—R group, an N—R' group, an oxygen atom, or a sulfur atom, where R and R' each independently represents a hydrogen atom or a substituent; and (c) carrying out gold sensitization, wherein step (b) and step (c) may be carried out simultaneously or in inverse order.

7. The method of preparing a composition for use in image formation according to claim 6, wherein the step of adding an oxidatively dimerized form is performed by mixing an Au (III) compound with the mesoionic compound comprising a thiolate structure to thereby produce the oxidatively dimerized form.

* * * * *